US008079592B1

(12) United States Patent
Butler

(10) Patent No.: US 8,079,592 B1
(45) Date of Patent: Dec. 20, 2011

(54) SUDOKU STRATEGIZER SOLUTION AIDE AND STRATEGY BOARD GAME

(76) Inventor: Charles Butler, Fort Lauderdale, FL (US)

( * ) Notice: Subject to any disclaimer, the term of this patent is extended or adjusted under 35 U.S.C. 154(b) by 0 days.

(21) Appl. No.: 13/005,338

(22) Filed: Jan. 12, 2011

Related U.S. Application Data

(62) Division of application No. 11/948,373, filed on Nov. 30, 2007.

(60) Provisional application No. 60/868,479, filed on Dec. 4, 2006.

(51) Int. Cl.
*A63F 13/00* (2006.01)

(52) U.S. Cl. ..... 273/138.1; 463/31

(58) Field of Classification Search ..... 273/138.1, 273/148 R, 153; 463/31
See application file for complete search history.

(56) References Cited

U.S. PATENT DOCUMENTS

2007/0138740 A1* 6/2007 Martineck et al. ..... 273/138.1
2007/0187888 A1* 8/2007 Dures et al. ..... 273/138.1
2007/0210516 A1* 9/2007 Bohac ..... 273/153 R
2008/0161106 A1* 7/2008 Morris ..... 463/31

* cited by examiner

*Primary Examiner* — Gene Kim
*Assistant Examiner* — Michael Dennis
(74) *Attorney, Agent, or Firm* — Gold & Rizvi, P.A.; H. John Rizvi; Glenn E. Gold

(57) ABSTRACT

An aide and strategy layout and method for the solution of a Sudoku puzzle utilizes a row grid (Y) and a column grid (Z). The player can utilize the three grids as well as box's to aid in solving the puzzle. The layout can be provided on paper or on a game board. The game board secures game pieces to the game board 300 via magnets, a cavity, adhesive, etc. An alternative game board utilizes a cellophane sheet and a black (or colored) backing material for removably scribing the solution. The solution aid can be automated using a computer processor, respective software, and a display.

3 Claims, 28 Drawing Sheets

SUDOKU STRATEGIZER SOLUTION AIDE AND STRATEGY BOARD GAME

CROSS-REFERENCE TO RELATED APPLICATIONS

This Divisional patent application claims the benefit of co-pending Non-Provisional patent application Ser. No. 11/948,373 filed on Nov. 30, 2007, which claims benefit of Provisional Patent Application Ser. No. 60/868,479 filed on Dec. 4, 2006 by the same inventor and which is incorporated by reference herein.

FIELD OF THE INVENTION

The present invention relates to logic board games in general and, more particularly, to a method and respective apparatus for solving Sudoku puzzles.

BACKGROUND OF THE PRESENT

Sudoku is a logic puzzle comprising a symmetrical grid having nine (9) rows and nine (9) columns. The nine rows and nine columns produce 81 squares, wherein the squares are referred to as cells. The 81 cells are grouped into nine (9) boxes, each box comprising three (3) rows and three (3) columns, having nine (9) cells per box. A region is defined as having three (3) adjacent boxes in either a row or a column. Each Sudoku puzzle comprises three (3) row regions and three (3) column regions.

The object of the Sudoku puzzle is to place a number from a set of Sudoku numbers, the set of Sudoku numbers being 1 through 9, into each row and each column, wherein each number is unique for each row and each column. Additionally, each box is to be completed with a unique number from the set of Sudoku numbers.

The common presentation of each Sudoku puzzle is in either a print version or a software/computer version.

Ideally, a method and apparatus that provides strategy and assistance for deriving a final solution to the game is desired.

SUMMARY OF THE INVENTION

The present invention is directed to a Sudoku puzzle visual aide and strategy method and respective apparatus for assisting a user in solving Sudoku puzzles.

A first aspect of the present invention is a layout comprising three (3) grids. The three (3) grids are as follows:

A. Grid X: A Sudoku puzzle grid;

B. Grid Y: A row grid; and

C. Grid Z: A column grid.

Yet another aspect of the present invention positions the row grid horizontally aligned with the Sudoku puzzle grid and the column grid vertically aligned with the Sudoku puzzle grid.

Yet another aspect utilizes the row grid and column grid as a means for keeping track of all played and not played game pieces.

Yet another aspect utilizes the row grid as a visual aid for the status of each row of the Sudoku puzzle.

Yet another aspect utilizes the column grid as a visual aid for the status of each column of the Sudoku puzzle.

Yet another aspect is to provide a Sudoku visual aide and strategy game board, which provides for a quicker and easier solution to Sudoku puzzles.

Yet another aspect of the present invention is to provide a Sudoku visual aide and strategy game board, which provides a secure playing area for the game pieces when the game is in play.

Yet another aspect incorporates cell reference markings for the Sudoku puzzle grid X. Column cell reference markings are identified via a numbering from 1 through 9, referenced respectively from left to right. Row cell reference markings are identified via lettering from A through I, referenced respectively from top to bottom.

Yet another aspect incorporates cell reference markings for the row grid Y. Column cell reference markings are identified via a numbering from 1 through 9, referenced respectively from left to right.

Yet another aspect incorporates cell reference markings for the column grid Z. Row cell reference markings are identified via, a numbering from 1 through 9, referenced respectively from top to bottom.

Yet another aspect incorporates game pieces for the row grid, the game pieces comprising a number on a first row game piece side and a number on a second row game piece side, wherein artwork on the first side is distinctly different from artwork on the second side.

Yet another aspect incorporates game pieces for the column grid, the game pieces comprising a number on a first column game piece side and a non-numbered artwork on a second column game piece side.

Yet another aspect presents a secure storage area for the game pieces when the game is not in play.

Yet another aspect presents a secure storage area for the game pieces when the game is not in play, wherein the secure storage area is the row grid (Y) and the column grid (Z).

Yet another aspect presents a secure storage area for the game pieces when the game is not in play, wherein the secure storage area is a sealable container.

Yet another aspect presents a secure storage area for the game pieces when the game is not in play, wherein the secure storage area is a sealable container incorporated into the game board.

Yet another aspect utilizes magnetic properties for securing the game pieces to the game board.

Yet another aspect utilizes magnetic properties for securing the game pieces to the game board, wherein the game board is fabricated incorporating a magnet and the game pieces are fabricated of a magnetic material.

Yet another aspect utilizes recessed pockets for securing the game pieces to the game board.

Yet another aspect utilizes an adhesive for securing the game pieces to the game board.

Yet another aspect utilizes a dense hook and eye material (commonly referred to as Velcro®) for securing the game pieces to the game board.

These and other features, aspects, and advantages of the invention will be further understood and appreciated by those skilled in the art by reference to the following written specification, claims, and appended drawings.

BRIEF DESCRIPTION OF THE DRAWINGS

For a fuller understanding of the nature of the present invention, reference should be made to the following detailed description taken in conjunction with the accompanying drawings in which.

Like reference numerals refer to like parts throughout the various views of the drawings.

DETAILED DESCRIPTION OF THE PREFERRED EMBODIMENT

Figure 1:
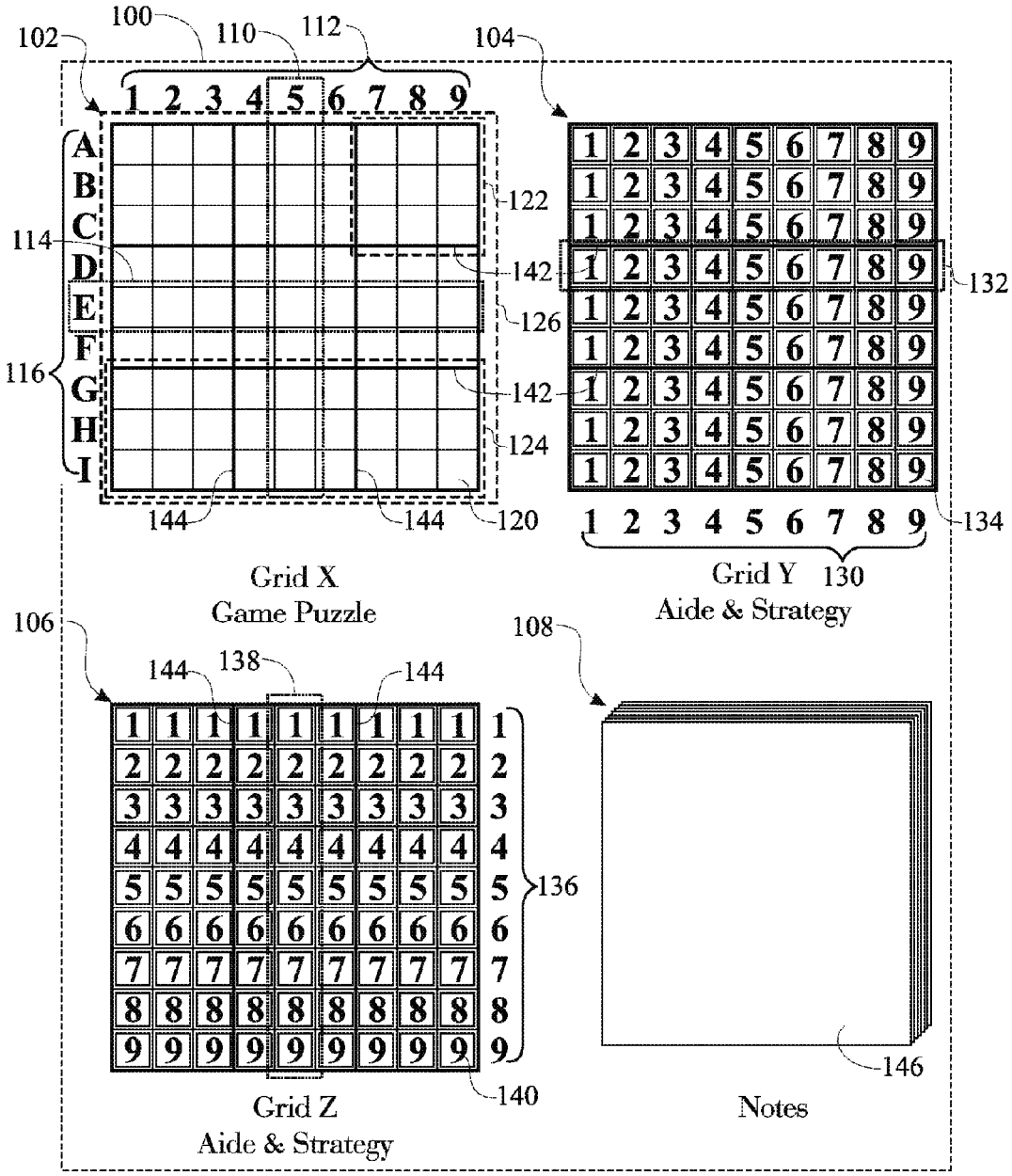
FIG. 1 is an exemplary representation of a Sudoku strategy aid layout.

For purposes of description herein, the terms "upper", "lower", "left", "rear", "right", "front", "vertical", "horizontal", and derivatives thereof shall relate to the invention as oriented in FIG. 1. However, one will understand that the invention may assume various alternative orientations and step sequences, except where expressly specified to the contrary. It is also to be understood that the specific devices and processes illustrated in the attached drawings, and described in the following specification, are simply exemplary embodiments of the inventive concepts defined in the appended claims. Hence, specific dimensions and other physical characteristics relating to the embodiments disclosed herein are not to be considered as limiting, unless the claims expressly state otherwise. Additionally noted, elements previously presented may be referred to in latter figures and may not specifically include reference numbers for clarity.

Turning to the drawings, FIG. 1 presents a generic configuration of a Sudoku strategy aid layout 100 and the respective basic features. The Sudoku strategy aid layout 100 includes three grids: a game puzzle grid (X) 102, a strategy row grid (Y) 104, and a strategy column grid (Z) 106. The game puzzle grid (X) 102 is provided for the playing the game. The strategy row grid (Y) 104 and the strategy column grid (Z) 106 are provided as aides in completing the game. The three (3) grids 102, 104, 106, in the preferred embodiment, are of equal size, which is important for row and column alignment purposes. The size and positioning of the three (3) grids is adjustable to fit the given embodiment, and any variation is size or position of the grids is to be considered apparent and obvious to the disclosure.

The game puzzle grid (X) 102 incorporates the elements of the game as well as references for each row and column as an aid for playing the game. The game puzzle grid (X) 102 generally comprises a nine (9) by nine (9) grid of puzzle cell 120. The grid comprises nine (9) puzzle column 1110, each puzzle column 110 identified via respective puzzle column identifiers 112. The game puzzle grid (X) 102, more specifically a puzzle layout 126, comprises nine (9) puzzle rows 114, each puzzle row 114 identified via a respective puzzle row identifiers 116. The game puzzle grid (X) 102 is segmented into nine (9) box 122, identified via a box horizontal defining line 142 and a box vertical defining line 144. The box 122 is a three (3) by three (3) grid of puzzle cell 120. The puzzle cells 120 are proportional in size to the grid, and therefore, the size of each cell 120 is determined by the size of the grid in which it is contained. A region 124 comprises three (3) adjacent box's 122 and can be oriented horizontally (as shown) or vertically (understood). A puzzle consists of nine (9) box's 122 arranged in a three (3) by three (3) grid for a total of eighty-one (81) puzzle cell 120.

The strategy row grid (Y) 104 is provided in a nine (9) by nine (9) array of row game piece 134, each row game piece 134 being placed into a marked cell. The strategy row grid (Y) 104 aids the user by informing the user of the status of each respective row of the game puzzle grid (X) 102. One of the objectives of the Sudoku puzzle is to place one and only one each of the numbers 1 through 9 across the row. Once a number is placed into the row of the game puzzle grid (X) 102, the same number is no longer used in the respective row. The strategy row grid (Y) 104 comprises nine (9) row grid row 132, each row grid row 132 including a series row game piece 134, wherein the series being one each of the numbers 1 through 9 as illustrated. Each column is identified via row grid identifiers 130. Additionally, the strategy row grid (Y) 104 includes a pair of region horizontal defining lines 142 as a visual aid for aiding in the association of each of the three (3) respective horizontal regions 124 of the game puzzle grid (X) 102.

The strategy column grid (Z) 106 is provided in a nine (9) by nine (9) array of column game piece 140, each column game piece 140 being placed into a marked cell. The strategy column grid (Z) 106 aids the user by informing the user of the status of each respective column of the game puzzle grid (X) 102. Another of the objectives of the Sudoku puzzle is to place one and only one each of the numbers 1 through 9 along the column. Once a number is placed into the column of the game puzzle grid (X) 102, the same number is no longer used in the respective column. The strategy column grid (Z) 106 comprises nine (9) column grid columns 138, each column grid column 138 including a series column game piece 140, wherein the series being one each of the numbers 1 through 9 as illustrated. Each row is identified via column grid identifiers 136. Additionally, the strategy column grid (Z) 106 includes a pair of region vertical defining lines 144 as a visual aid for aiding in the association of each of the three (3) respective vertical regions 124 of the puzzle grid (X) 102.

The Sudoku strategy aid layout 100 can additionally include a notes section 108 providing the user with an area for making notations. A note pad 146 can be placed in the notes section 108, providing the user with a means for making notes and discarding the notes as needed.

The Sudoku strategy aid layout 100 is presented on a game board. The game board can be made out of, and printed on, a variety of materials, including but not limited to, a cardboard based material, paper products, fabric, plastic, wood, and a multitude of other materials not referred to herein which are to be considered apparent and obvious to the disclosure.

Figure 2:
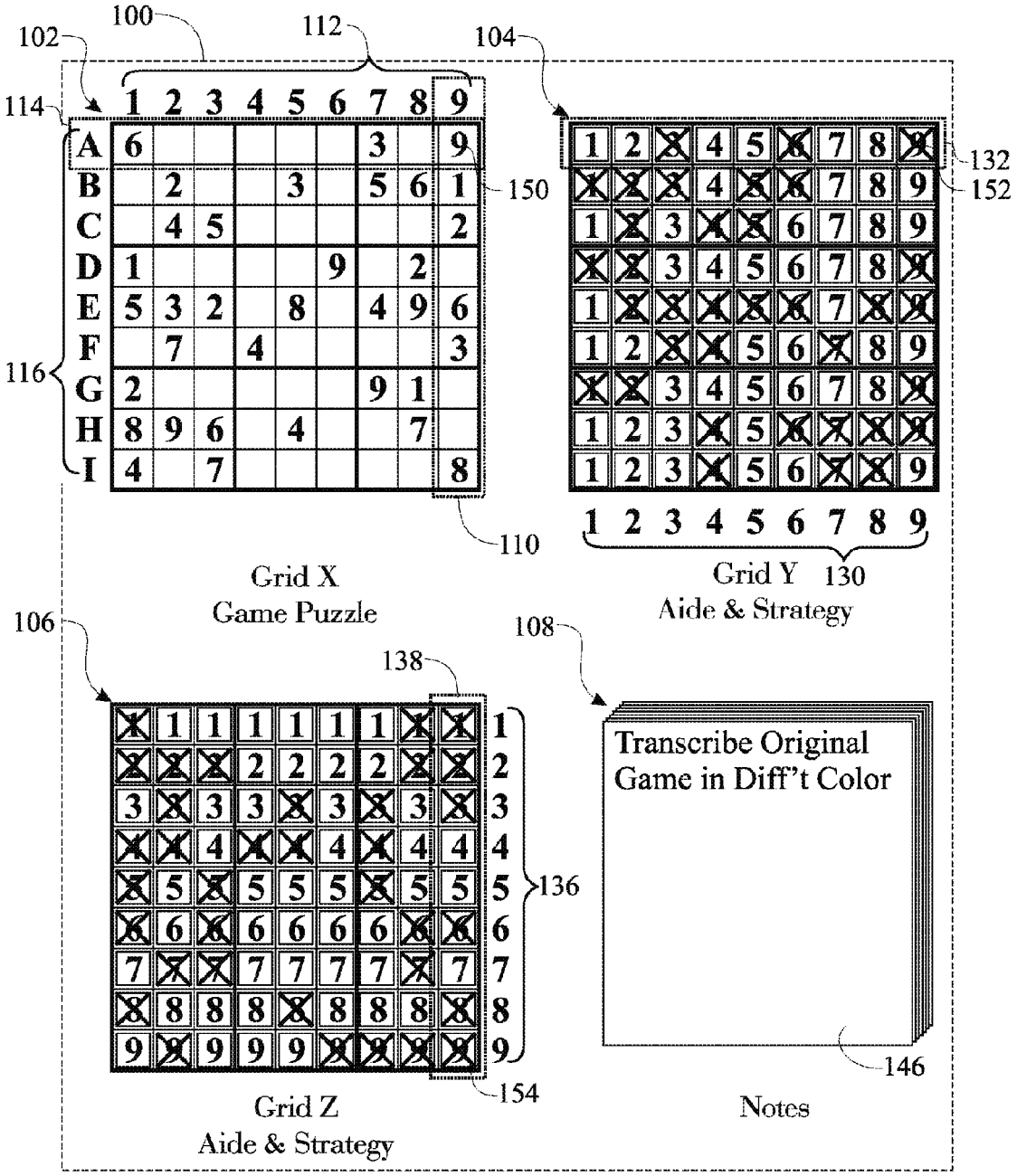
FIG. 2 presents the exemplary representation of a Sudoku strategy aid layout as presented in FIG. 1 introducing placement of starter numbers utilizing a paper system.
Figure 3:
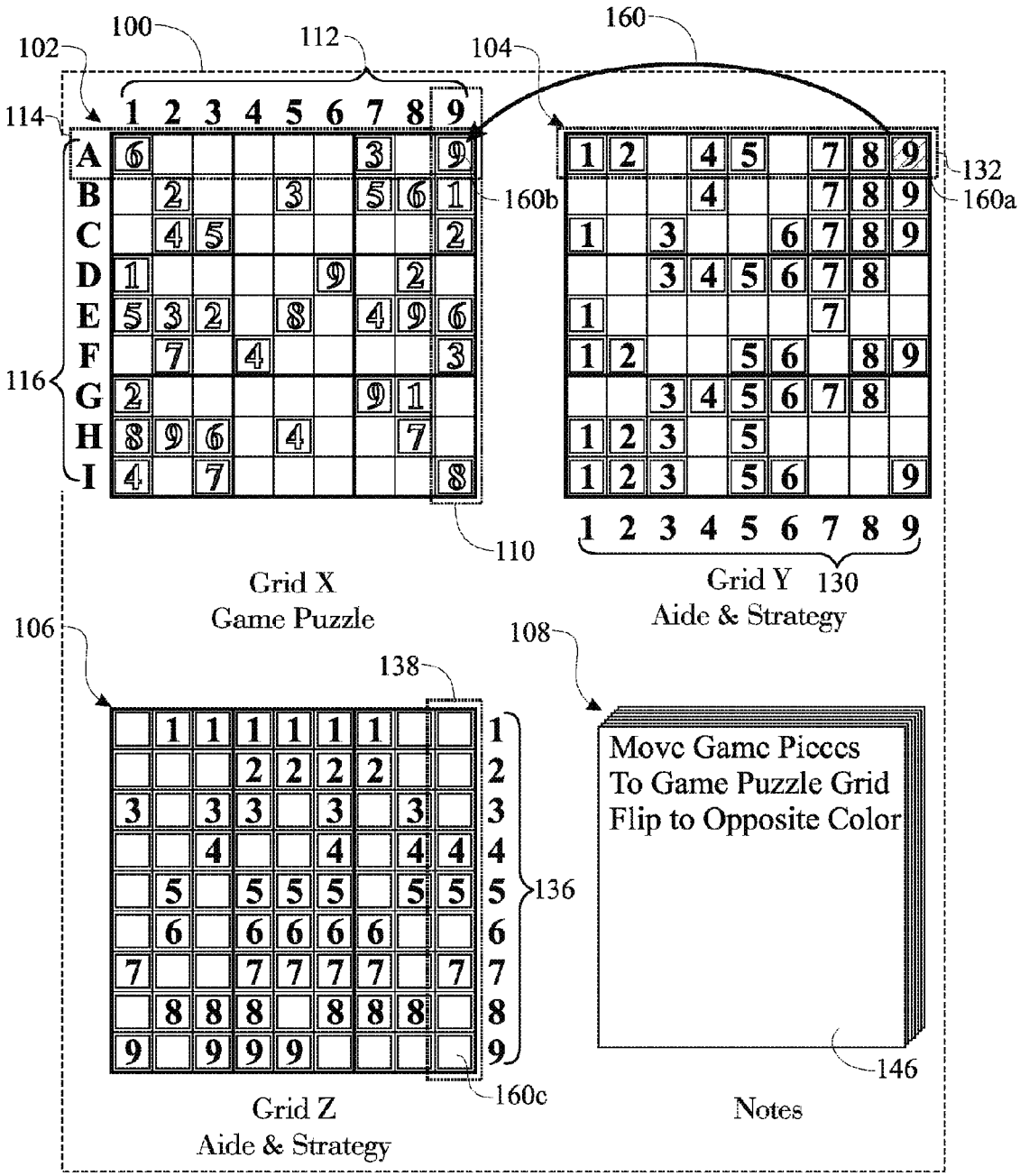
FIG. 3 presents the exemplary representation of a Sudoku strategy aid layout as presented in FIG. 1 introducing placement of starter numbers utilizing game pieces.

The initial start configuration is presented as two different embodiments, as illustrated in FIGS. 2 and 3. A paper version is presented in FIG. 2 and a game piece version is presented in FIG. 3. The concept behind each is the same, with a slight variation upon the execution of each. An original game is provided via a book, Internet, and the like, and is copied onto the game puzzle grid (X) 102. In the paper version, the original game configuration is generated by writing the numbers in the respective cells 120 in a color, which differs from the solution color. As each number is written into the respective puzzle cell 120 of the puzzle grid (X) 102, that number is identified in the respective row grid row 132 and marked out. An example is presented via starter number 150 (number "9") being written into cell A9 of the puzzle grid (X) 102. The number "9" is the identified in the respective row grid row 132 and marked out 152. The same number "9" is identified in the respective column grid column 138 and marked out 154. This is repeated until all of the starter numbers are entered into the puzzle grid (X) 102.

In the game piece version, the original game configuration is generated by identifying and placing the respective row game piece 134 into the respective cell 120. This is illustrated as a starter game piece move 160. In accordance with the starter game piece move 160, the player identifies the starter number in the row grid row 132 of the row grid (Y) 104, removes the row game piece 160*a* from the row grid row 132, flips the game piece 160*a* to the opposite side, and places the game piece 160 into the respective starter cell of the puzzle grid (X) 102 a starter puzzle game piece 160*b*.

In parallel with each started game piece move 160, the user identifies the same number in the same column. The identified column grid game piece is flipped over, and placed back into the same cell as illustrated via a played column game piece 160*c*. This process is repeated until all starter pieces are transferred from the row grid (Y) 104 to the puzzle grid (X) 102 and each respective number is identified in the row grid (Y) 104 and the column grid (Z) 106. Upon completion of arranging the starter configuration, the player is ready to begin solving the Sudoku puzzle.

The player can utilize the Sudoku strategy aid layout 100 as an aid in solving the puzzle. The user scans in three different groupings to correctly identify which number is placed into a respective cell. The method of solving the puzzle utilizing the Sudoku strategy aid layout 100 is demonstrated in FIGS. 4 through 15 herein.

Figure 4:
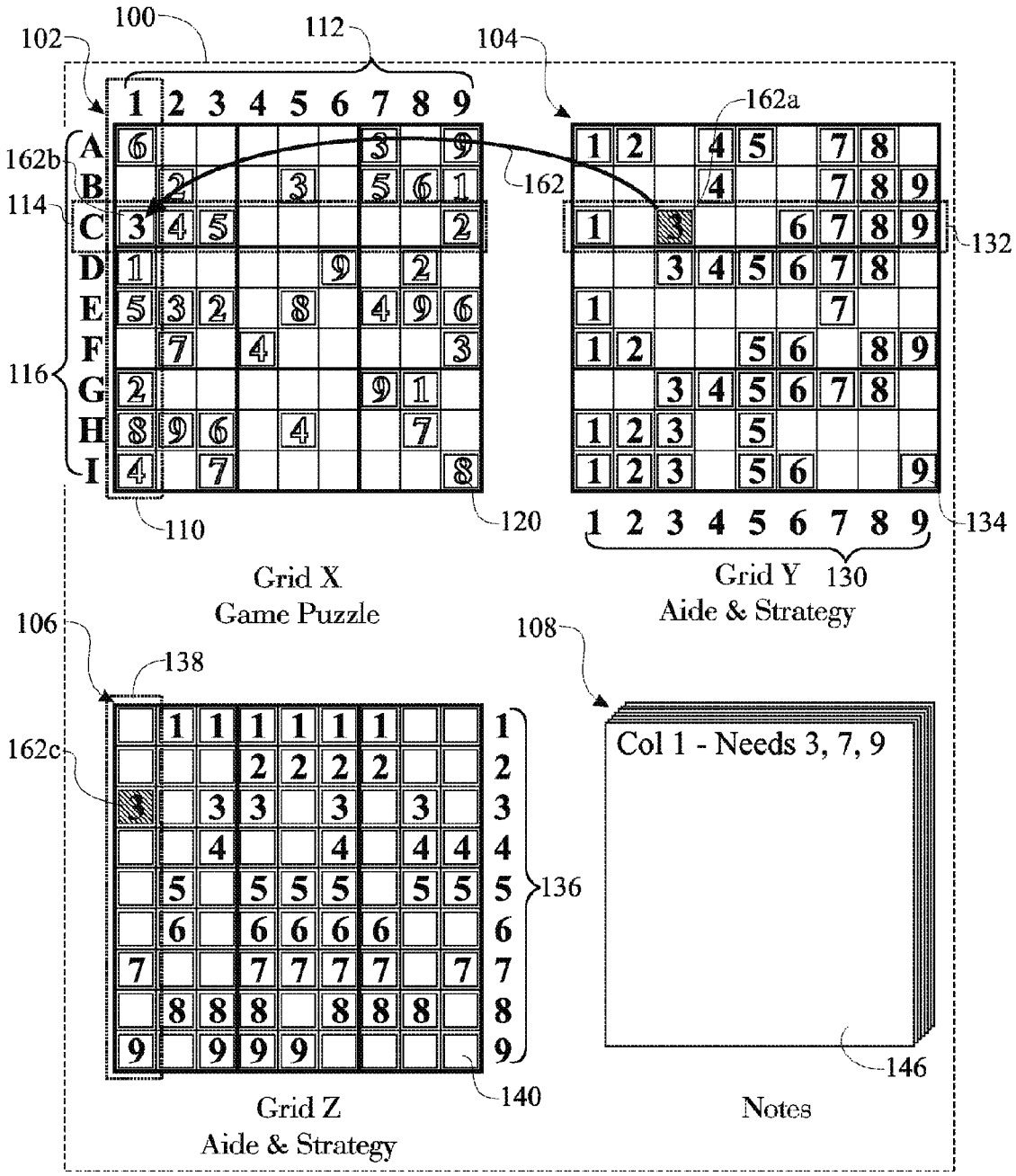
FIG. 4 presents the exemplary representation of a Sudoku strategy aid layout, further presenting steps respective to a first move of the game utilizing column based aiding decision steps.

The player scans the row grid (Y) 104 and the column grid (Z) to determine the lowest number of remaining numbers. Referring to FIG. 4, the lowest quantity of remaining numbers (2) is found in row E of row grid (Y) 104. The two numbers are 1 and 7. Puzzle row 114 (E) has two vacant cells 120, found in columns 4 and 6. The column grid (Z) 106 presents that both numbers have not been played in either column 4 or 6 and therefore doesn't provide a solution. The next lowest quantity of remaining numbers (3) is found in column 138 (1) of the column grid (Z) 106. The three remaining numbers are 3, 7, and 9. The puzzle column 110 (1) has vacant cells in puzzle rows 114 (B, C, and F). By scanning the row grid (Y) 104, the player identifies that the number "3" is already used in rows 132 (B and R therefore, the number "3" can only be placed into cell 1C. The player transfers the row game piece 162*a* in accordance with move 162 to cell 1C as illustrated via puzzle game piece 162*b*. The move is also recorded by flipping the associated column game piece 162*c* in the respective column 138 (1). Ali subsequent moves are identified as follows: the move is identified as move "###"; the row game piece is identified as "###a"; the puzzle game piece is identified as "###b"; and the column game piece is identified as "###c";

wherein "###" is a variable representative of the respective move element number. This scheme is provided for clarity and to minimize repetitive information.

Figure 5:
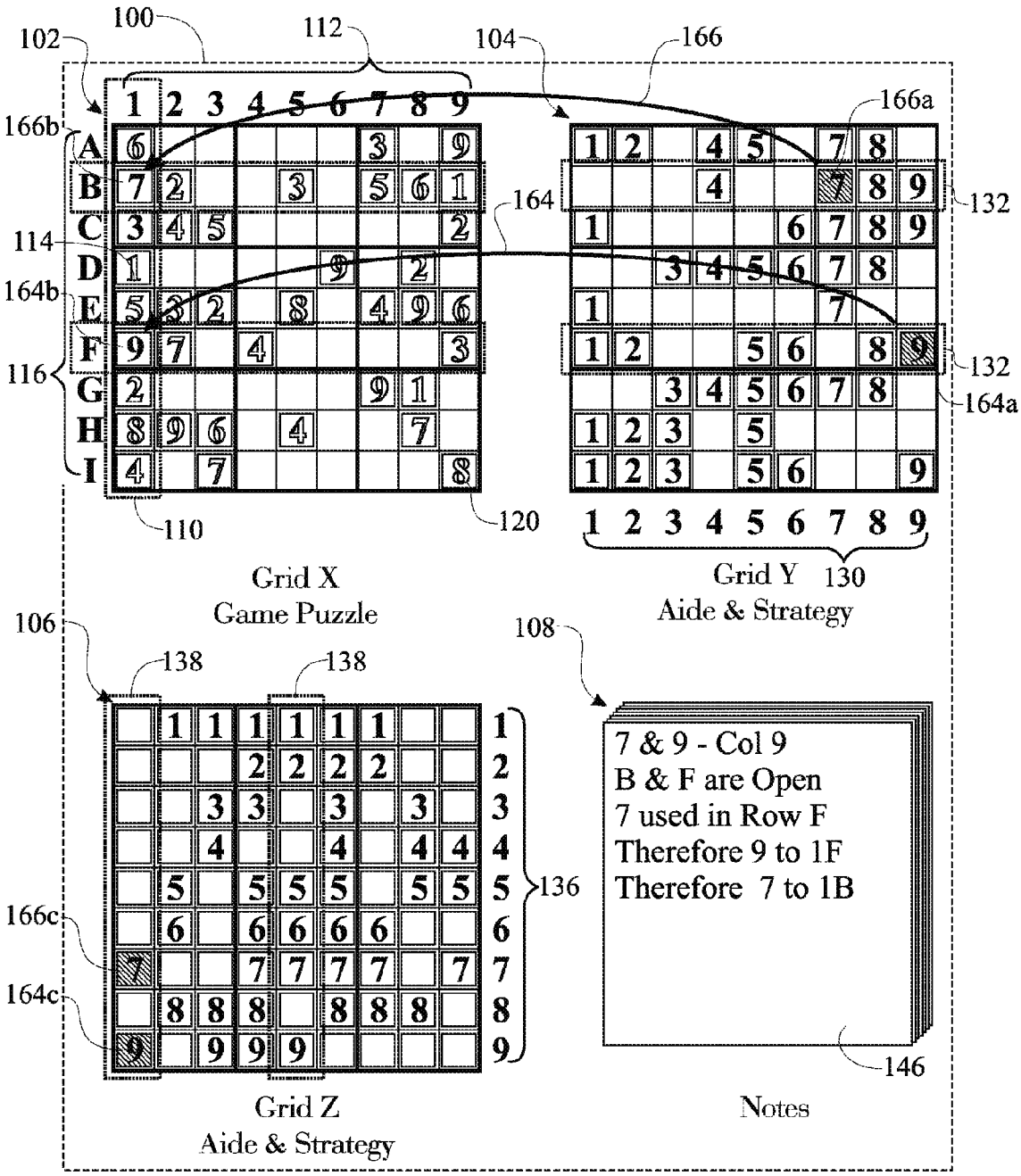
FIG. 5 presents the exemplary representation of a Sudoku strategy aid layout, further presenting steps respective to a next moves of the game utilizing column based aiding decision steps.

Referring to the moves presented in FIG. 5, continuing with the same column 138 (1), the remaining numbers are "7" and "9". The puzzle column 110 (1) has vacant cells in puzzle rows 114 (B and F). By scanning the row grid (Y) 104, the player identifies that the number "7" is already used in row 132 (F) therefore, the number "7" can only be placed into cell 113 and the player completes the move in accordance with move 166. Column 138 (1) has only one number "9" remaining. The number "9" is then placed in the one remaining vacant cell (cell 1F) of puzzle column 110 (1) and the player completes the move in accordance with move 164.

Figure 6:
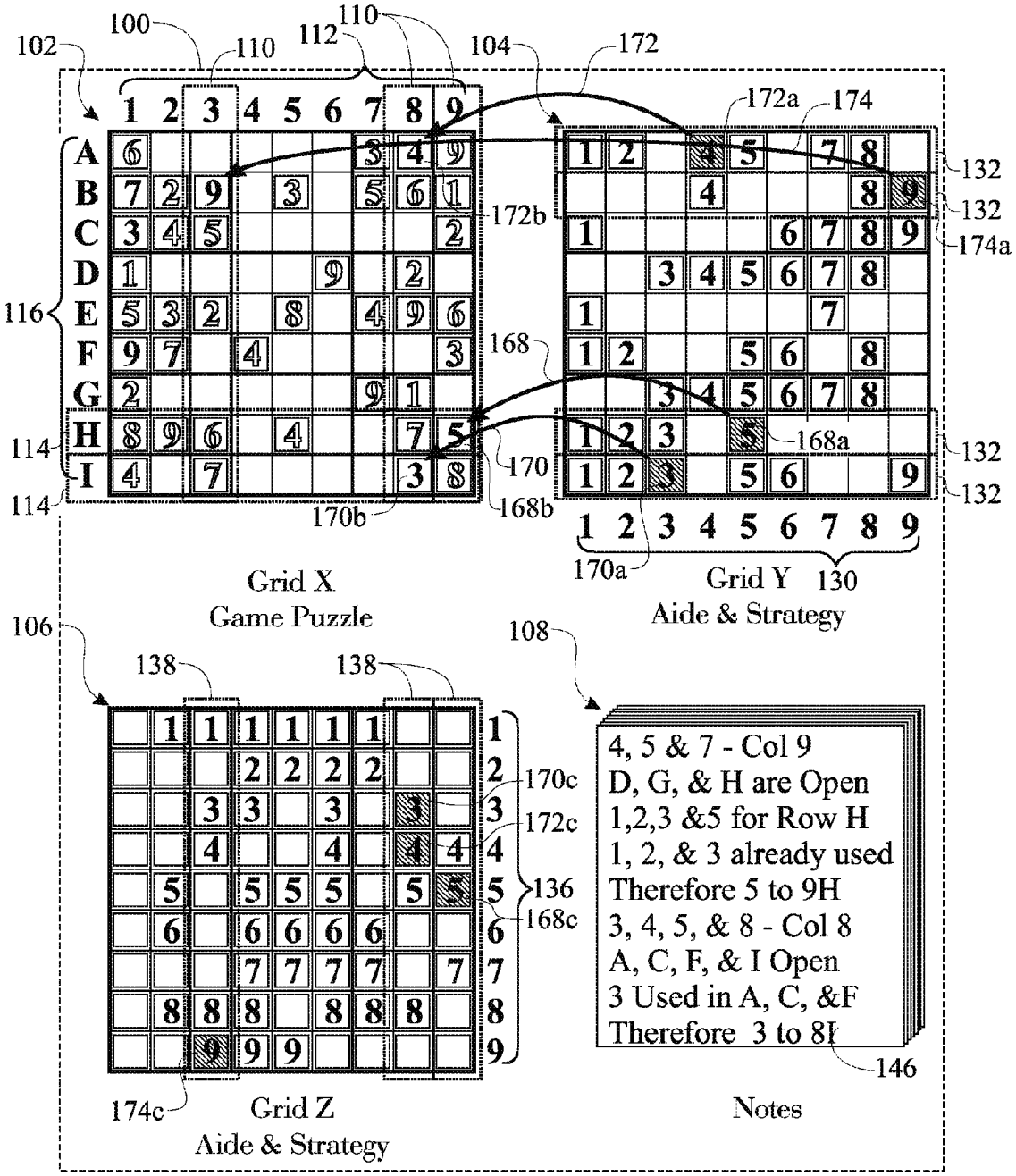
FIG. 6 presents the exemplary representation of a Sudoku strategy aid layout, further presenting steps respective to a next moves of the game utilizing column based aiding decision steps and row based aiding decision steps.

Referring to the moves presented in FIG. 6, row 132 (E) has not improved in aiding in the solution. Therefore, the player can consider using row 132 (B), row 9 of the column grid (Z) 106, column 138 (8), and column 138 (9). Column 138 (9) of column grid (Z) 106 presents "4", "5", and "7" are available for placement. The puzzle column 110 (9) has vacant cells in puzzle rows 114 (D, G, and H). By scanning row 132 (H) of row grid (Y) 104, the player identifies that the numbers "4" and "7" are already used. Therefore, the number "5" can only be placed into cell 9H and the player completes the move in accordance with move 168. Column 138 (8) of column grid (Z) 106 presents "3", "4", "5", and "8" are available for placement. The puzzle column 110 (8) has vacant cells in puzzle rows 114 (A, C, F, and 1). By scanning column (3) of row grid (Y) 104, the player identifies that the number "3" is available in four rows 132 (D, G, H, and I), but three of the four of the respective puzzle rows 114 (D, G, and H) already have numbers inserted. Therefore, the number "3" can only be placed into the remaining cell, cell 81 and the player completes the move in accordance with move 170. The same is repeated for the number "4", noting the number "4" is available in four rows 132 (A, B, D, and G), but three of the four of the respective puzzle rows 114 (B, D, and G) already have numbers inserted. Therefore, the number "4" can only be placed into the remaining cell, cell 8A and the player completes the move in accordance with move 172. Scanning the remaining numbers in the aide and strategy boards, the number "9" has only three remaining placements, in puzzle columns 110 (3, 4, and 5) and puzzle rows 114 (B, C, and Puzzle column 110 (3) has numbers already inserted into puzzle rows 114 (C and I). Therefore, the number ")" can only be inserted into cell 3B and the player completes the move in accordance with move 174.

Figure 7:
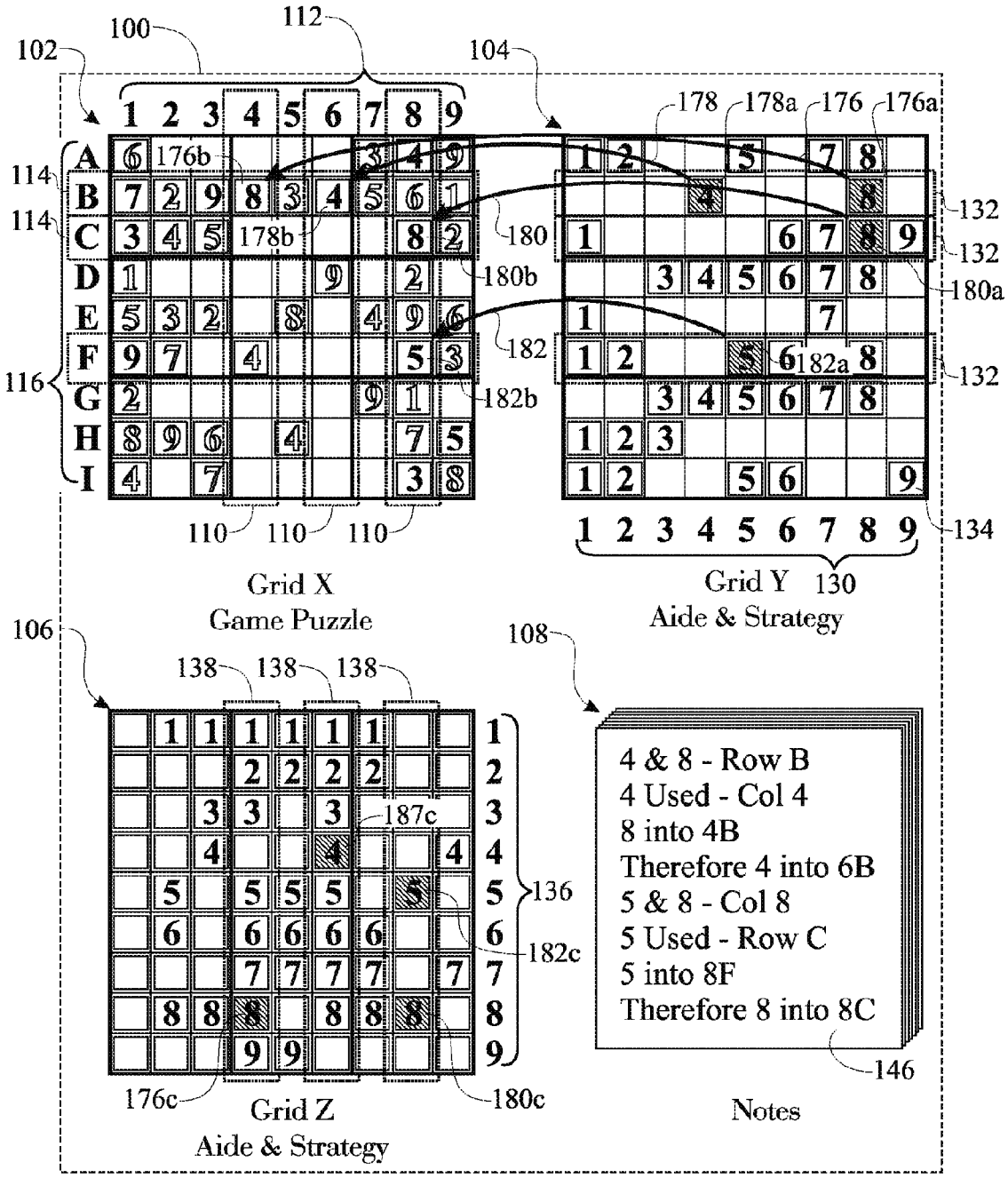
FIG. 7 presents the exemplary representation of a Sudoku strategy aid layout, further presenting steps respective to a next moves of the game utilizing column based aiding decision steps and row based aiding decision steps.

Referring to the moves presented in FIG. 7, row 132 (B) has now improved in aiding in the solution. Row 132 (B) of row grid (Y) 104 presents "4" and "8" are available for placement. The puzzle row 114 (B) has vacant cells in puzzle columns 110 (4 and 6). By scanning column 138 (4) of column grid (Z) 106, the player identifies that the number "4" is already used. Therefore, the number "8" can only be placed into cell 4B and the player completes the move in accordance with move 176. Additionally, the number "4" can only be placed into cell 6B and the player completes the move in accordance with move 178. Column 138 (8) of column grid (Z) 106 presents "5" and "8" are available for placement. The puzzle column 110 (8) has vacant cells in puzzle rows 114 (C and F). By scanning rows 132 (C and F) of row grid (Y) 104, the player identifies that the number "4" is already used in row 132 (C). Therefore, the number "8" can only be placed into cell 8C and the player completes the move in accordance with move 180, Additionally, the number "5" can only be placed into cell 8F and the player completes the move in accordance with move 182.

Figure 8:
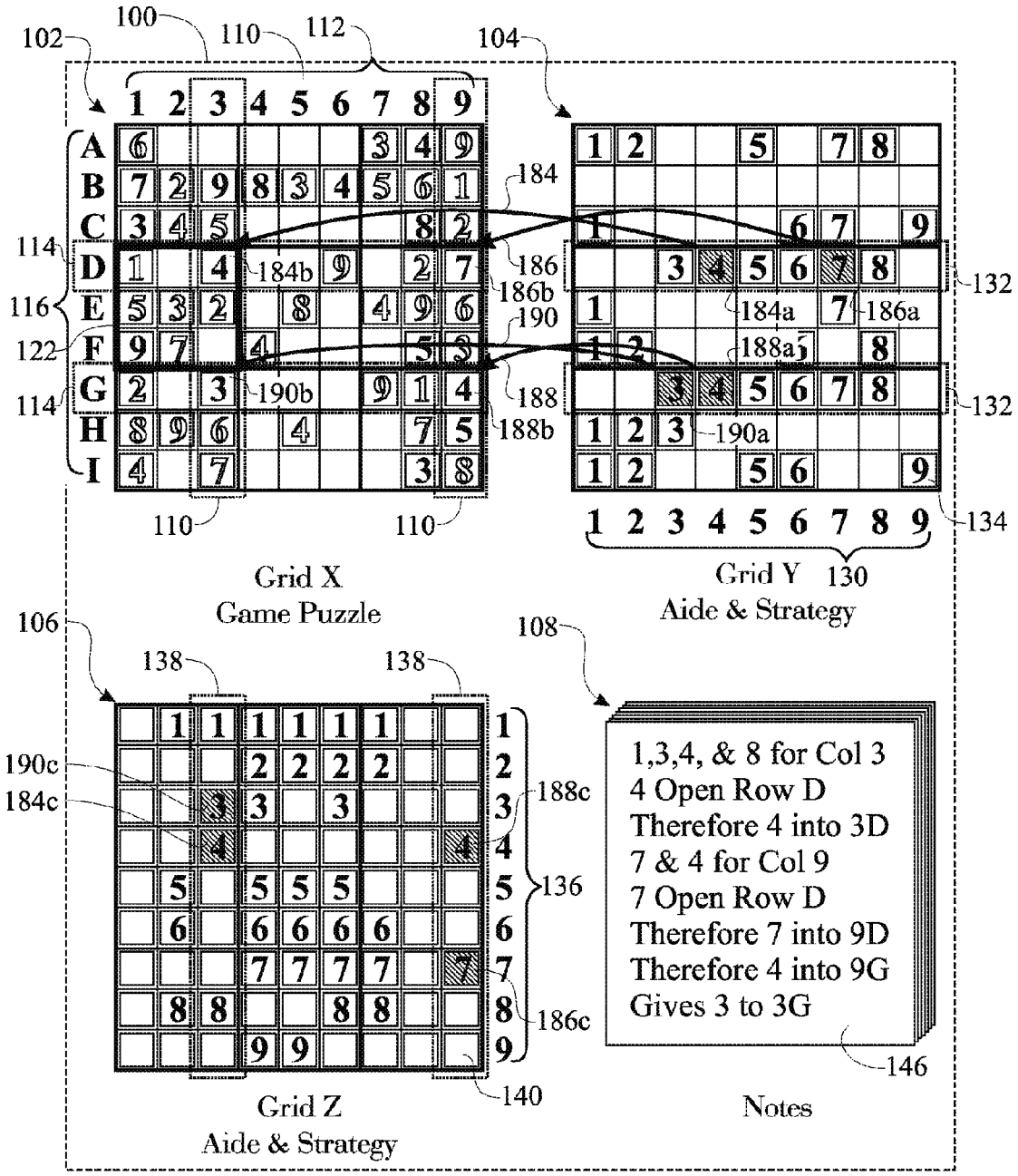
FIG. 8 presents the exemplary representation of a Sudoku strategy aid layout, further presenting steps respective to a next moves of the game utilizing column based aiding decision steps and row based aiding decision steps.

Referring to the moves presented in FIG. 8, column 138 (9) of column grid (Z) 106 presents "4" and "7" are the only remaining numbers for placement within that column 138 (9). The puzzle column 110 (9) has vacant cells in puzzle rows 114 (D and G). In reviewing the row grid (Y) 104, the numbers "4" and "7" are both available for each of the two open puzzle rows 114 (D and G), therefore this method does not provide a solution, Looking further, the box 122 (1D) already has a number "7", leaving the number "4" as available for the box 122 (1D). Therefore the number "4" is placed into cell 3D and the player completes the move in accordance with move 184. Column 138 (9) of column grid (Z) 106 presents "5" and "8" are available for placement. The puzzle column 110 (9) has vacant cells in puzzle rows 114 (D and G). By scanning rows 132 (D and G) of row grid (Y) 104, the player identifies that the number "4" is already used in row 132 (D) (previously played in move 184). Therefore, the number "7" can only be placed into cell 9D and the player completes the move in accordance with move 186. Additionally, the number "4" can only be placed into cell 9G and the player completes the move in accordance with move 188.

Further scanning within FIG. 8, the player can recognize column 9 of row grid 104 having only two "9's". The puzzle columns 110 (4 and 5) have vacant cells in puzzle rows 114 (C and Therefore, the placement of the "9's" is indeterminate at this time using this method. The player continues, recognizing column 138(3) of column grid (Z) 106 presents "1", "3", and "8" are still available for placement. Considering the three first (least quantity of placements available compared to the quantity of the numbers "1" and "8" still remaining), Column 3 of the row grid (Y) 104 presents that the number "3" can be placed into puzzle rows 114 (D, G, and H). Puzzle cell 3H already received the number "6", therefore, it is no longer considered open for placement. A number "3" is already placed within box 122 (1D). Therefore, the only remaining available cell for the number "3" is 3G and the player completes the move in accordance with move 190.

Figure 9:
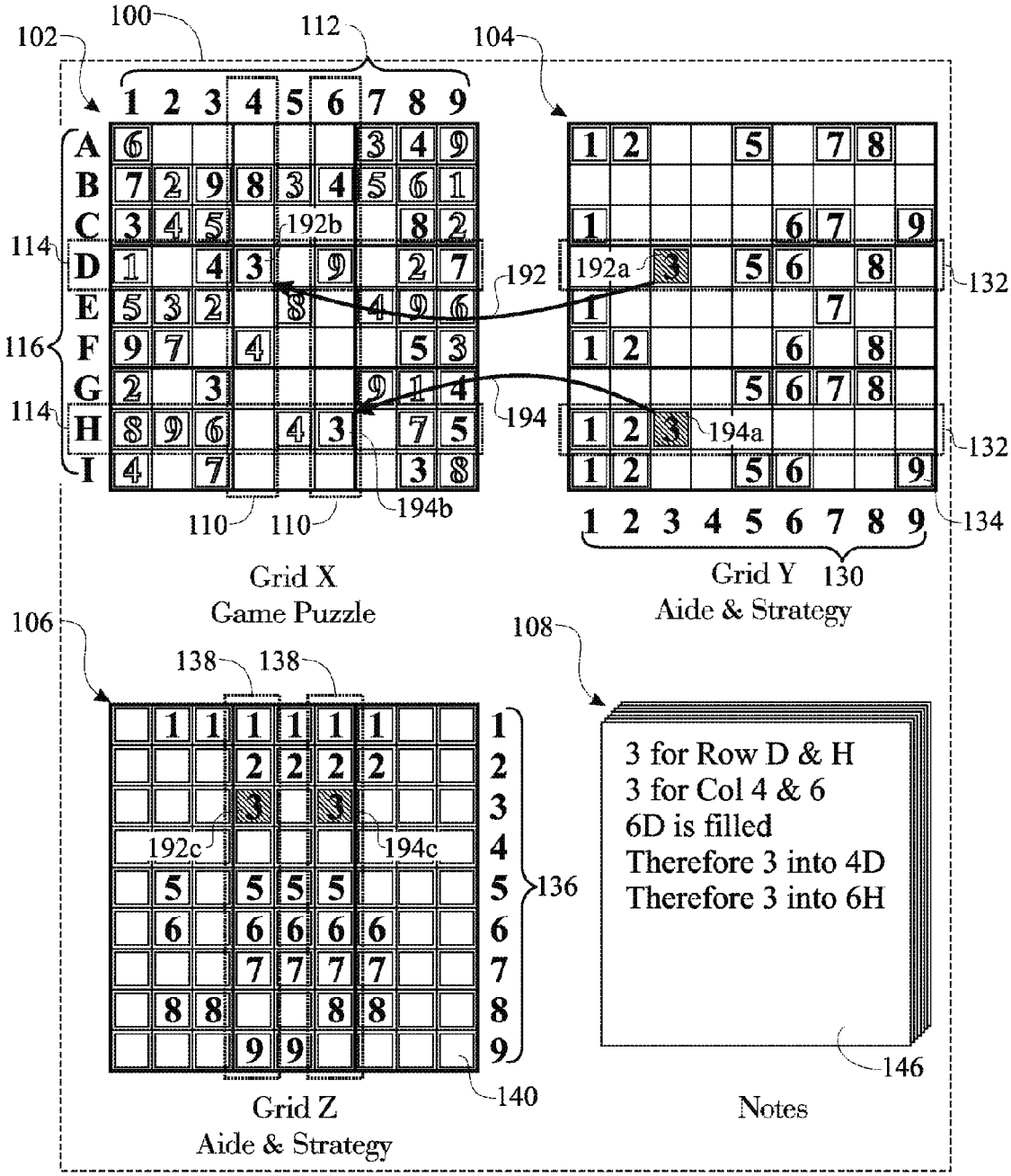
FIG. 9 presents the exemplary representation of a Sudoku strategy aid layout, further presenting steps respective to a next moves of the game utilizing the row based aiding decision steps.

Referring to the moves presented in FIG. 9, the player recognizes the number "3" and the number "9" equal in the lowest remaining quantities available for placement with two (2) per number, Rows 132 (D & H) note that puzzle columns 110 (4 & 6) still need placement of the number "3". Columns 138 (4 & 6) note that puzzle columns 110 (4 & 6) still need placement of the number "3". Considering the four potentially available puzzle cells (4D, 6D, 4H, & 6H), the player recognizes cell 6D as already having the number "9", therefore the number "3" must be placed into cell 41) and the player completes the move in accordance with move 192, The only remaining number "3" is then placed into cell 6H and the player completes the move in accordance with move 194.

Figure 10:
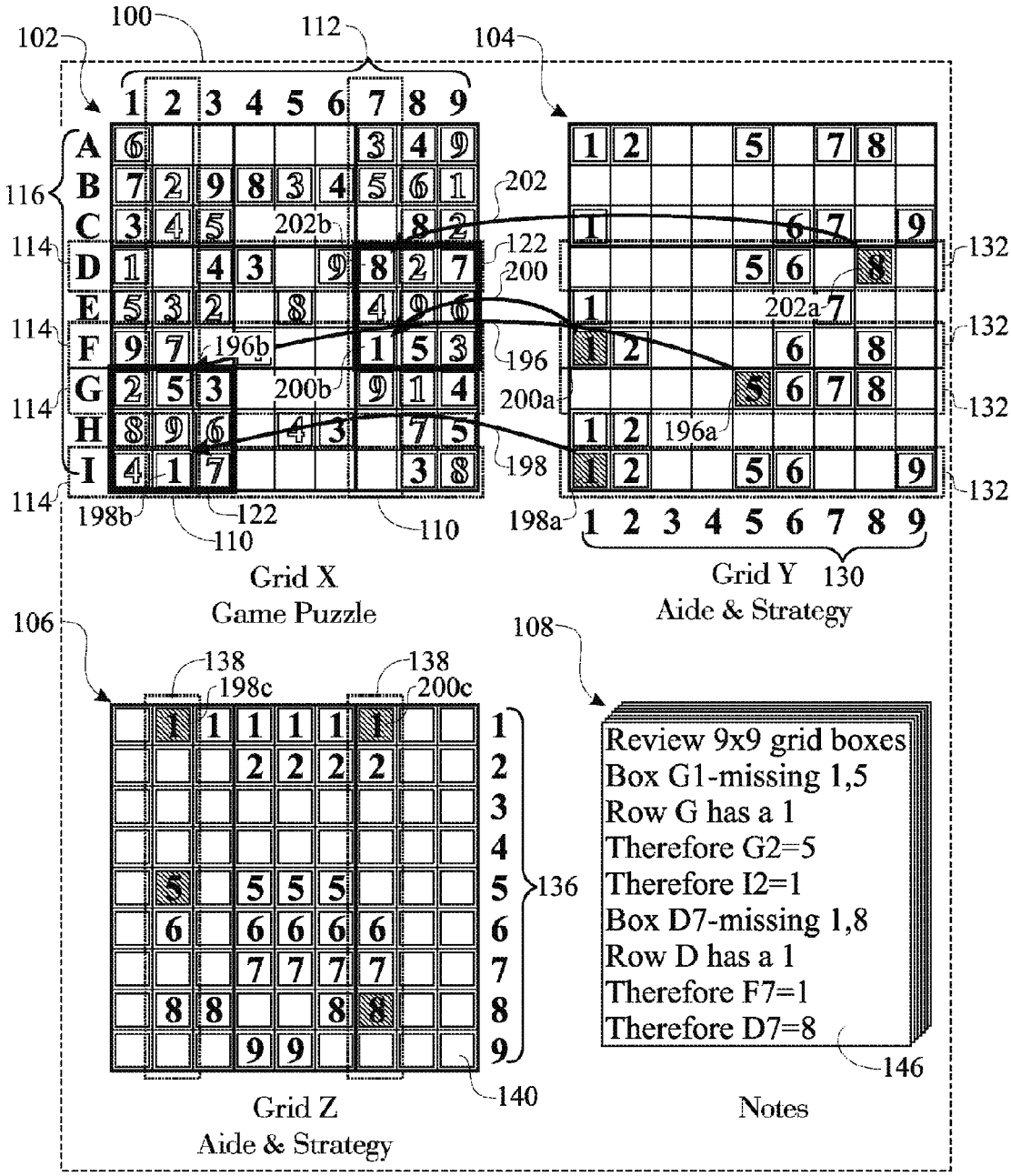
FIG. 10 presents the exemplary representation of a Sudoku strategy aid layout, further presenting steps respective to a next moves of the game utilizing box based decision steps.

Referring to the moves presented in FIG. 10, the player notes the various rows 132, columns 138 and quantities of numbers are high and the simple solution methods are limited. Using column 138(2) of column grid (Z) 106, four numbers are available for play "1", "5", "6" and "8". The player can then turn to the use of a box 122 to determine number placements. Investigating box 122 (1G) the numbers "6" and "8" have already been played, leaving the numbers "1" and "5" for placement. By viewing the row 132 of row grid (Y) 104, the player notes the number "1" is no longer available for play in row 132 (G), therefore the number "5" must be placed into cell 2G and the player completes the move in accordance with move 196. With that, the number "1" is then placed into cell 21 and the player completes the move in accordance with move 196, A similar process is completed within box 122 (7D). Box 122 (7D) has two open cells 120 (7D and 7F), and only two remaining numbers "1" and "8". By reviewing rows 132 (D & F) of row grid (Y) 104, the player identities from row 132 (D) that the number "1" has previously been played. Therefore, the number "1" must be placed into cell 7F and the player completes the move in accordance with move 200. Therefore, the remaining number "8" to complete the box 122 (7D) is placed into cell 7D and the player completes the move in accordance with move 202.

Figure 11:
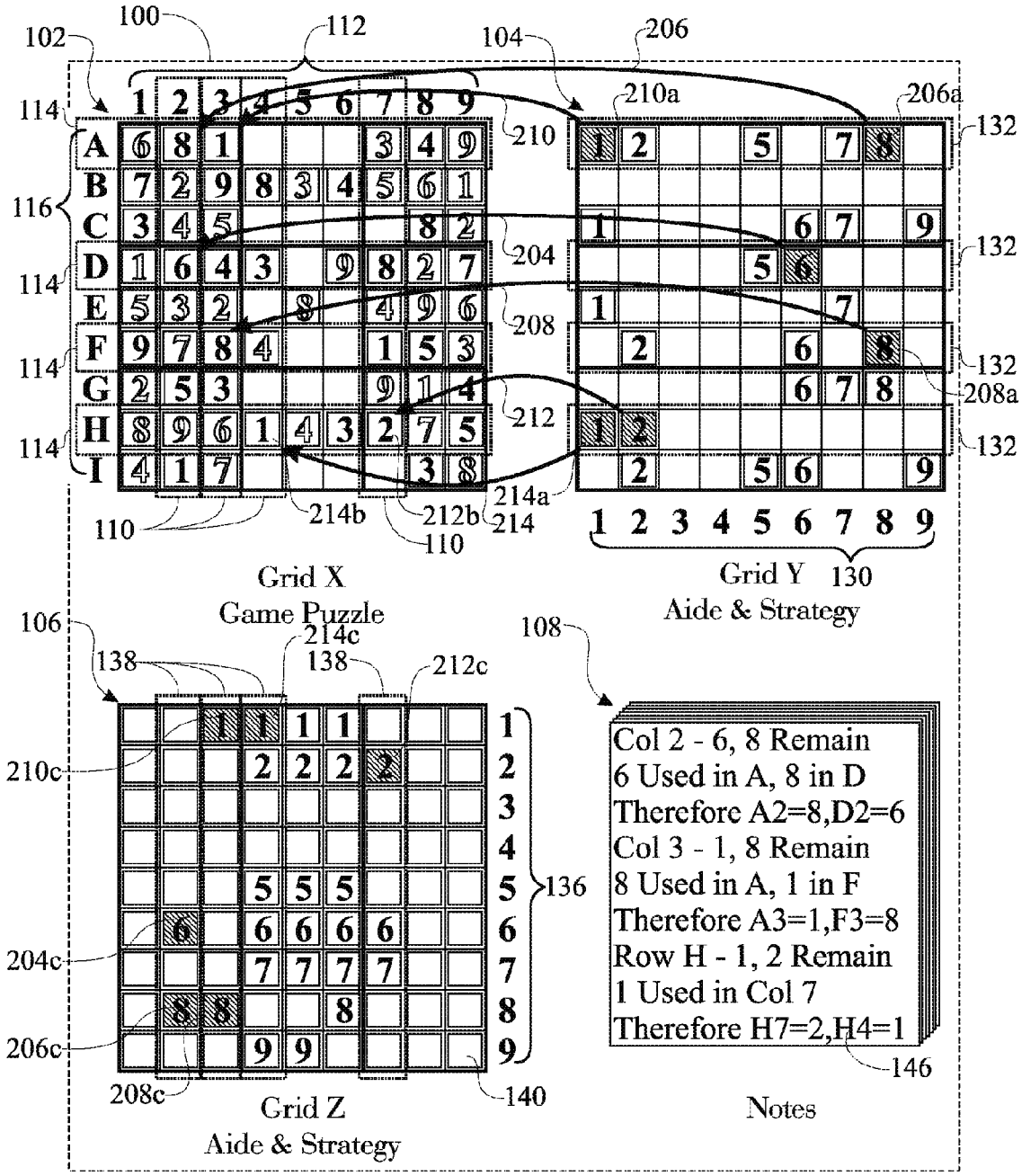
FIG. 11 presents the exemplary representation of a Sudoku strategy aid layout, further presenting steps respective to a next moves of the game utilizing column based aiding decision steps and row based aiding decision steps.
Figure 12:
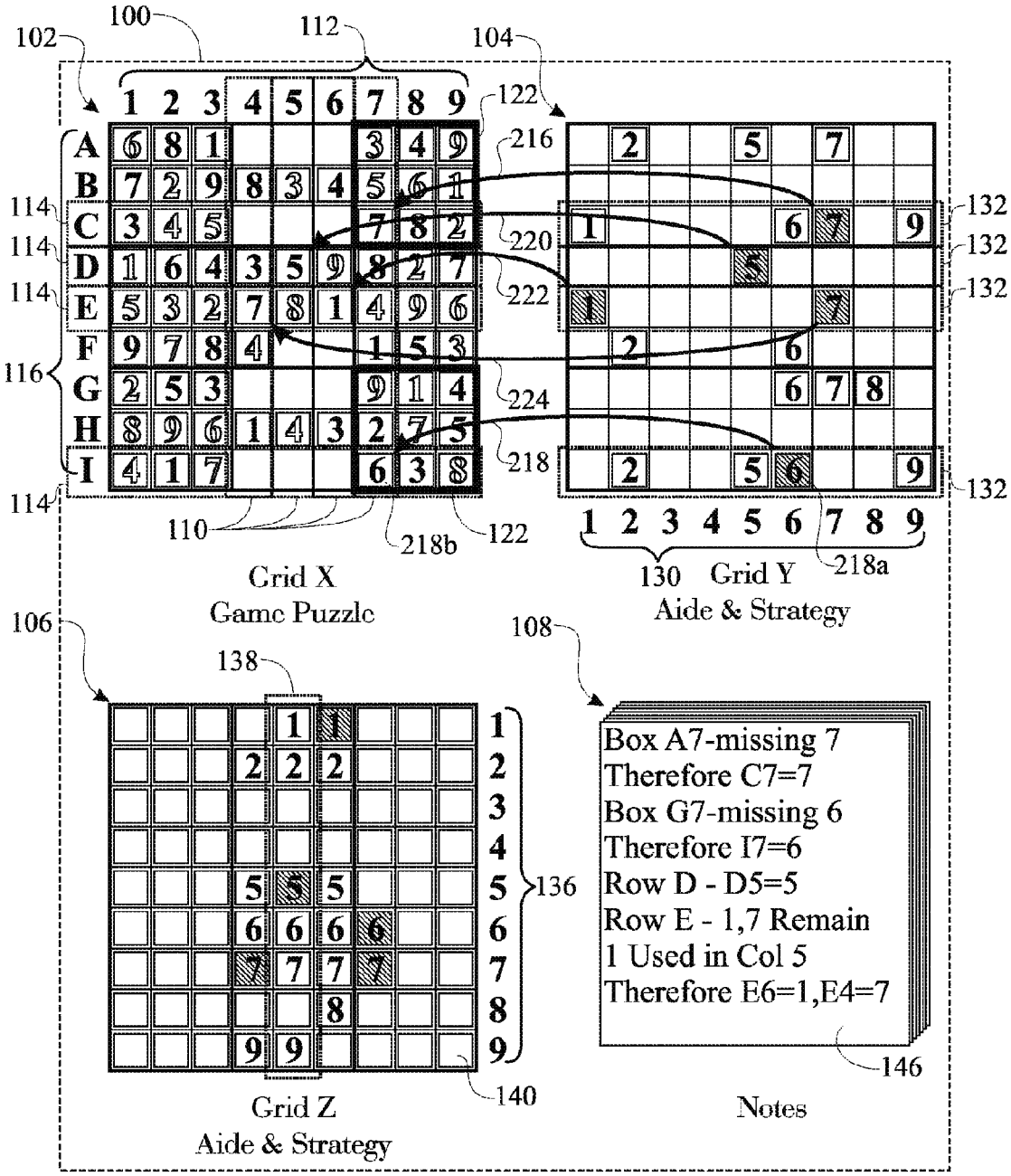
FIG. 12 presents the exemplary representation of a Sudoku strategy aid layout, further presenting steps respective to a next moves of the game utilizing box based decision steps as well as row based aiding decision steps.

The puzzle solution continues in FIG. 11, Column 138 (2) of column grid 106 presents two remaining numbers "6" and "8". The number "6" is already used in puzzle row 114 (A), therefore the number "6" is placed into cell 2D and the player completes the move in accordance with move 204 and the number "8" is placed into cell 2A and the player completes the move in accordance with move 206. Continuing forward, column 138 (3) of column grid 106 presents two remaining numbers "1" and "8". The number "1" is already used in puzzle row 114 (F), therefore the number "8" is placed into cell 3F and the player completes the move in accordance with move 208 and the number "1" is placed into cell 3A and the player completes the move in accordance with move 210. Looking at the strategy grids, row 132 (H) of the row grid (Y) 104 only has two numbers "1" and "2". Puzzle row 114 (H) has two vacant cells in columns 110 (4 and 7). Column 7 already has the number "2", therefore, the number "2" is placed into cell 7H and the player completes the move in accordance with move 212 and the number "1" is placed into cell 4H and the player completes the move in accordance with move 214.

With the number placements into puzzle column 110 (7), the player can recognize that each of the two box's 122 (7A and 7G) have only one (1) remaining placement each. Box 122 (7A) indicates the number "7" is needed in cell 7C, therefore, the number "7" is placed into cell 7C and the player completes the move in accordance with move 216. Box 122 (7G) indicates the number "6" is needed in cell 71, therefore, the number "6" is placed into cell 71 and the player completes the move in accordance with move 218. The player continues to scan for clearly identified moves and recognizes row 132 (D) has only one remaining number, the number "5". Puzzle row 114 (D) only has one available cell 120 (5D), Therefore, the number "5" is placed into cell 5D and the player completes the move in accordance with move 220. Continuing, the player recognizes row 132 (E) has two remaining numbers, the numbers "1" and "7". Conversely, inspecting the two open puzzle columns 110 (4 and 6) of puzzle row 114 (E), the number "1" was previously placed column 110 (4). Therefore, the number "1" is placed into cell 6E and the player completes the move in accordance with move 222 and the number "7" is placed into cell 4E and the player completes the move in accordance with move 224.

Figure 13:
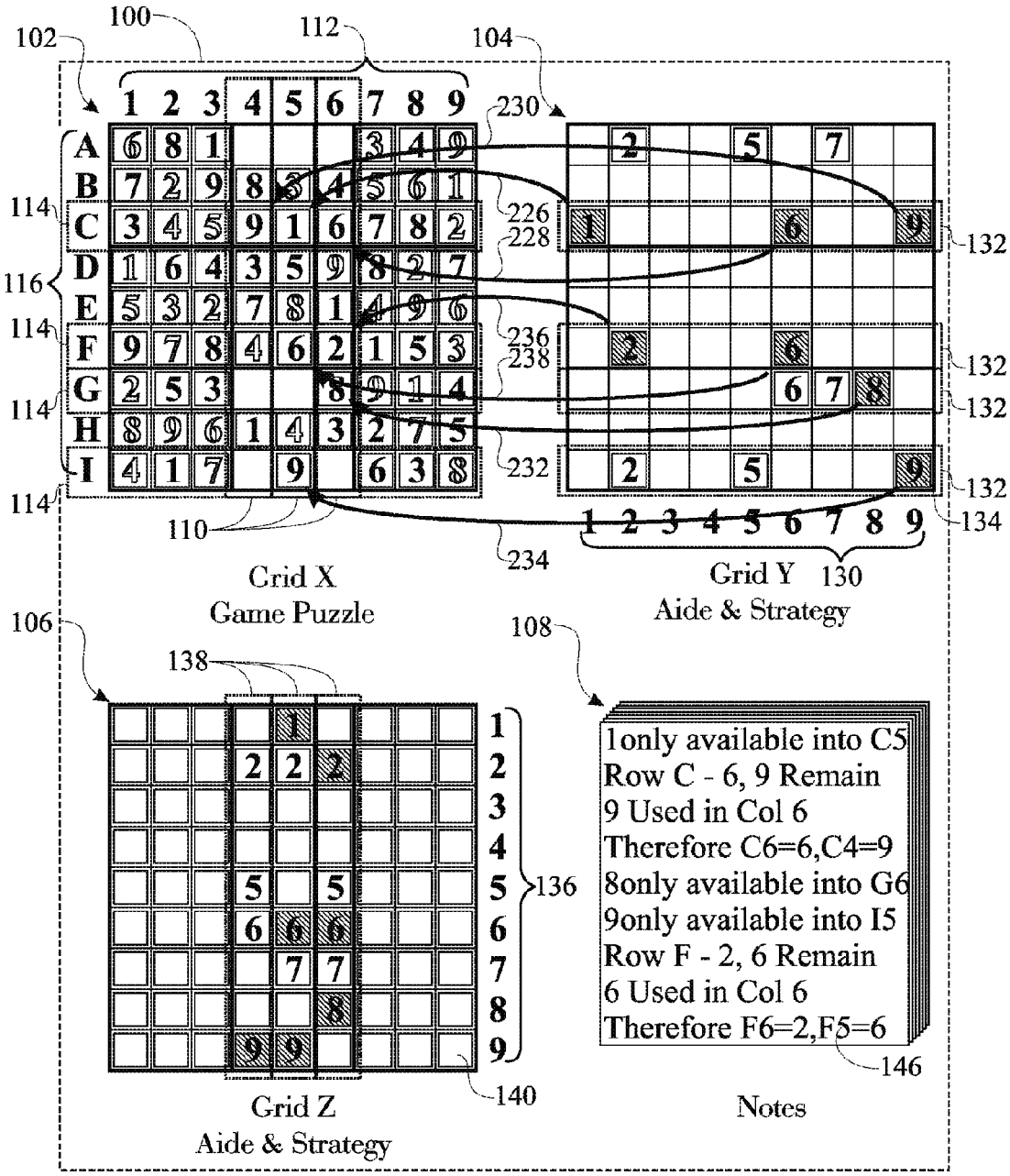
FIG. 13 presents the exemplary representation of a Sudoku strategy aid layout, further presenting steps respective to a next moves of the game utilizing column based decision via the row grid (Y) and row based aiding decision steps.
Figure 14:
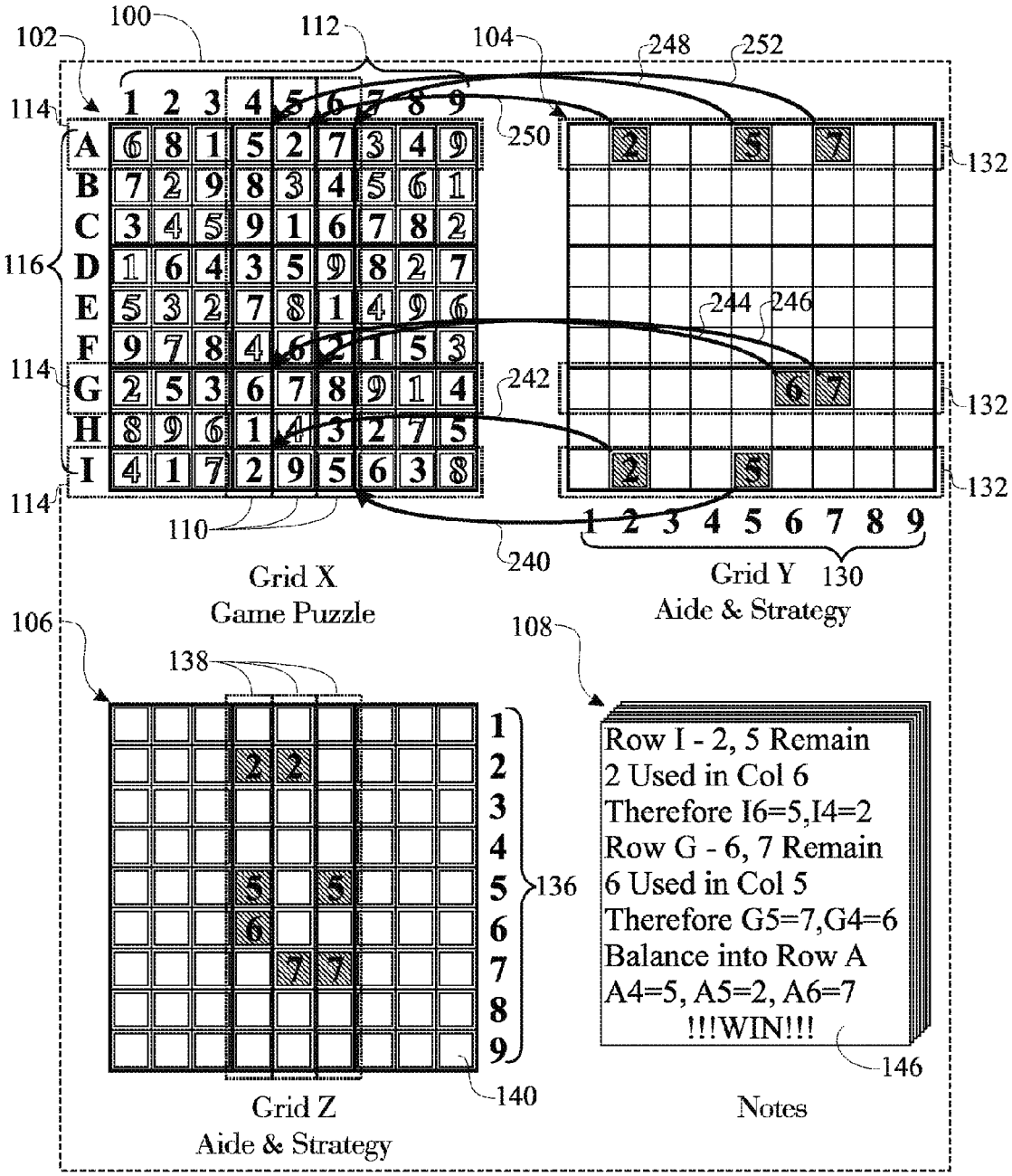
FIG. 14 presents the exemplary representation of a Sudoku strategy aid layout, presenting the final steps of the game utilizing column based decision via the column grid (Z) and row based aiding decision steps.

The puzzle is completed via moves presented in FIGS. 13 and 14. Each of the moves is concluded from analyzing the scenarios in manners similar to those previously presented. Moves 226, 228, 230, 232, 234, 236, and 238 are illustrated in FIG. 13, Details of the moves are provided as notes in notes section 108 of FIG. 13. Moves 240, 242, 244, 246, 248, 250, and 252 are illustrated in FIG. 14. Details of the moves are provided as notes in notes section 108 of FIG. 14.

Figure 15:
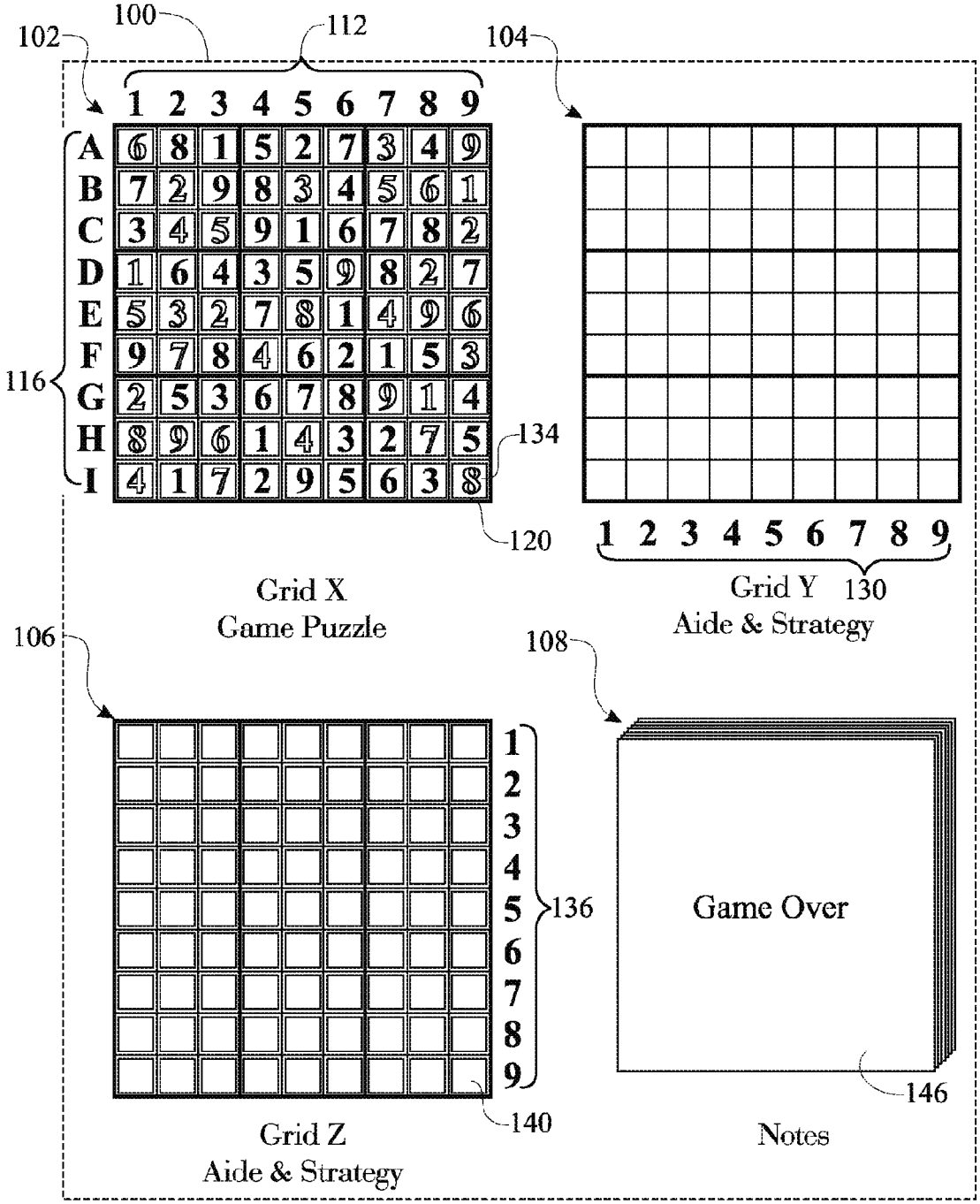
FIG. 15 presents the exemplary representation of a Sudoku strategy aid layout in a finished configuration.
Figure 16:
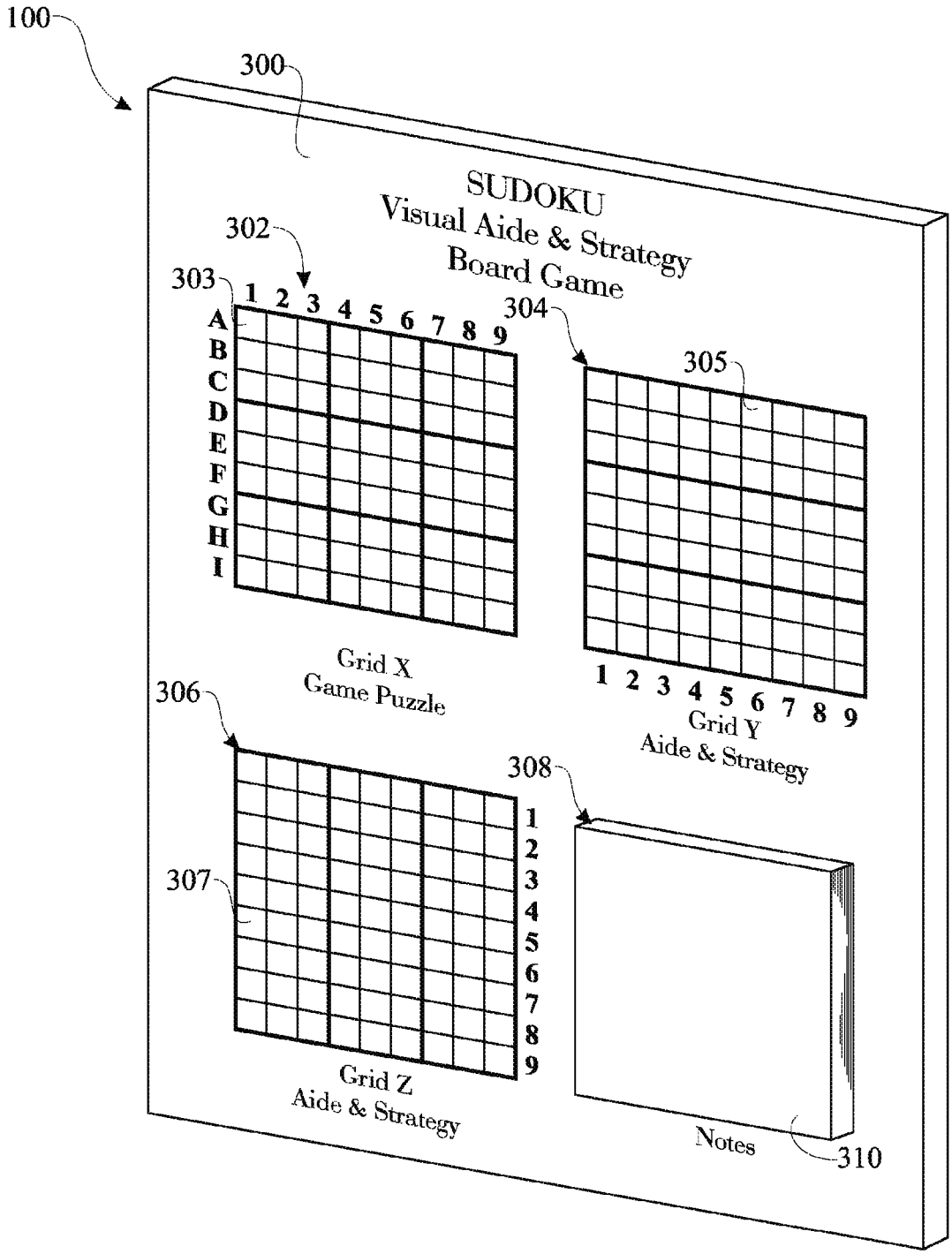
FIG. 16 is an isometric, top view of a Sudoku Visual Aid and Strategy board game in accordance with a first exemplary embodiment.
Figure 17:
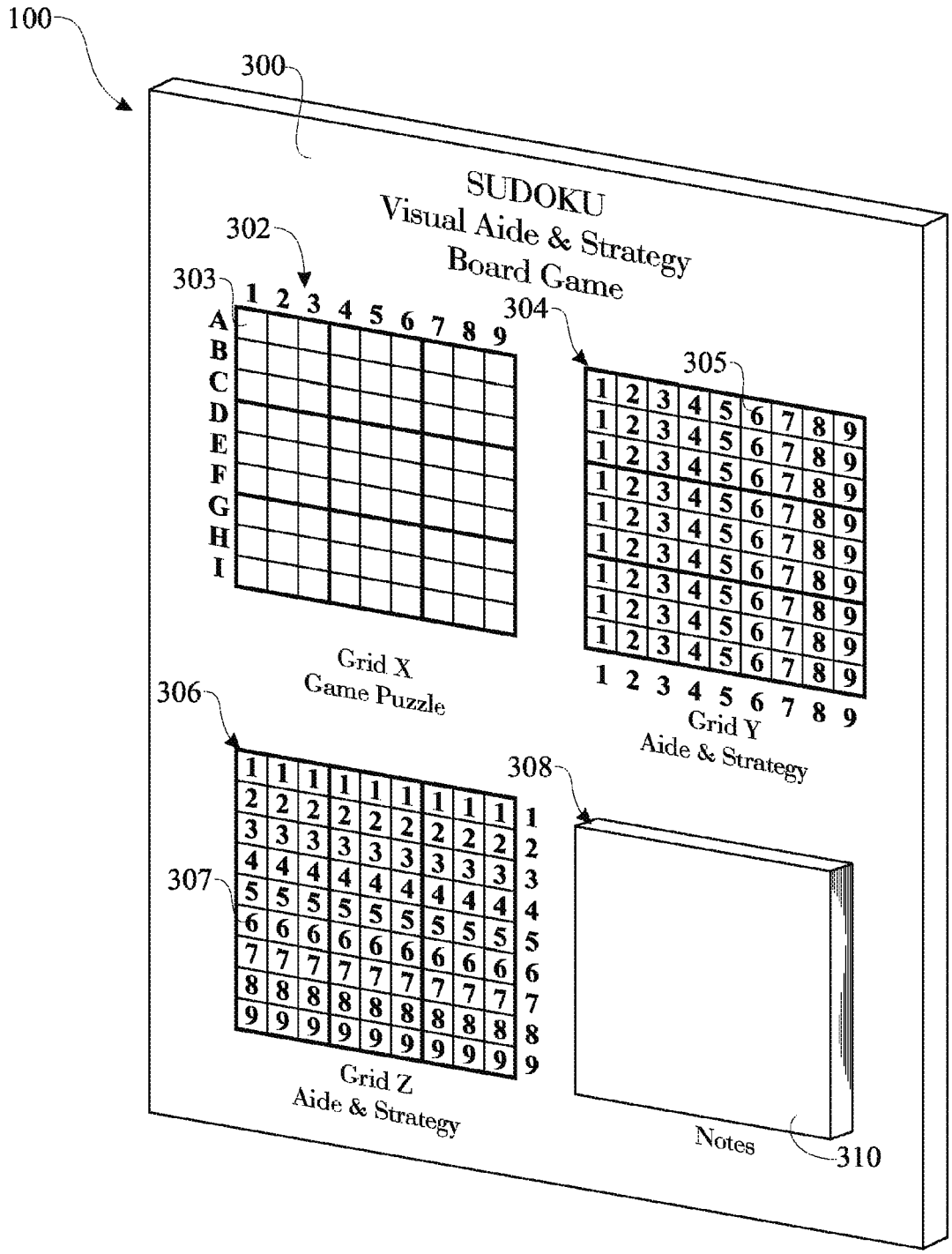
FIG. 17 is an isometric, top view of a Sudoku Visual Aid and Strategy board game of FIG. 16, further comprising a numbered layout within the cells of each of the row grid and column grid.
Figure 18:
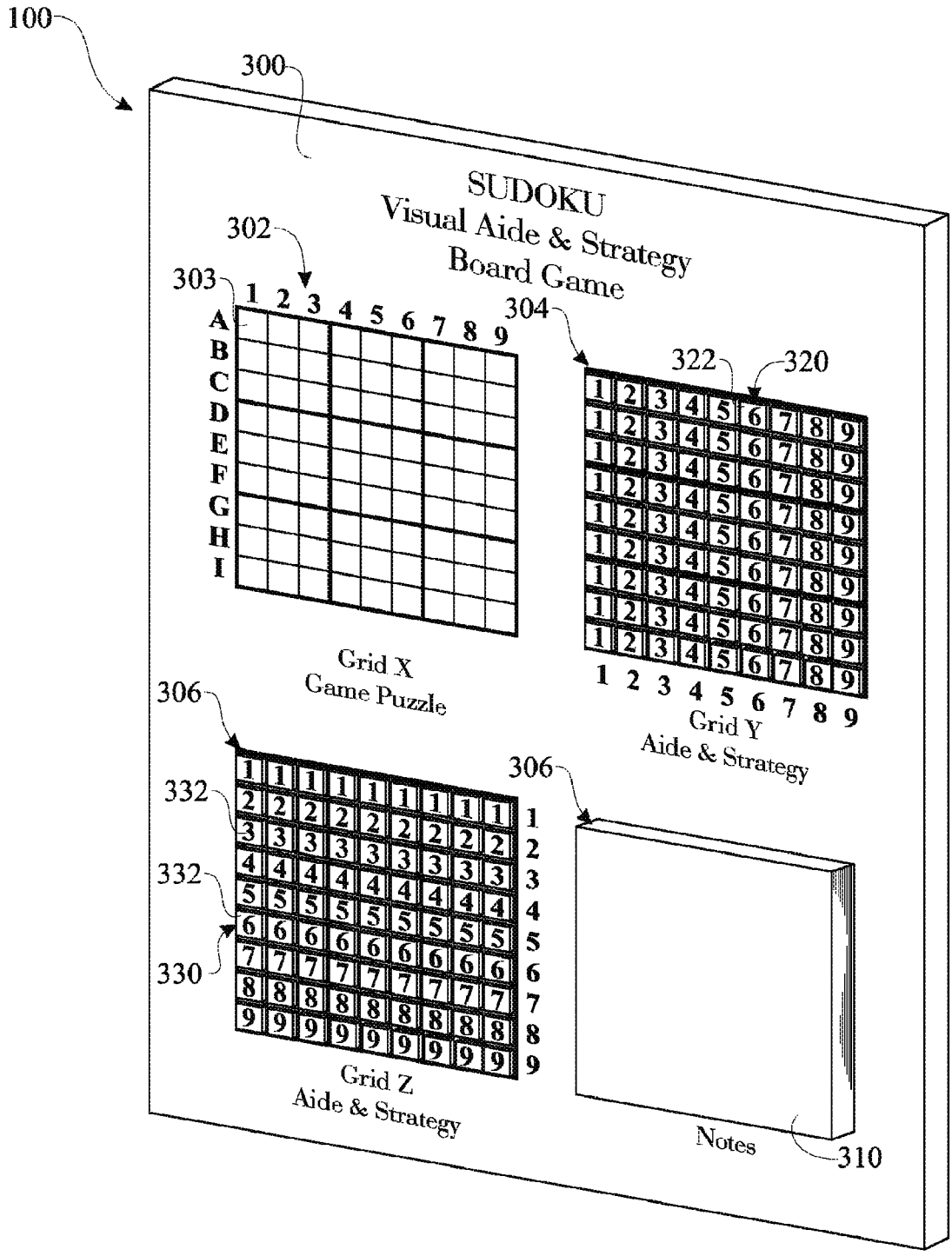
FIG. 18 is an isometric, top view of a Sudoku Visual Aid and Strategy board game of FIG. 16, further comprising game pieces.

A completed Sudoku puzzle game board 100 is presented in FIG. 15. The puzzle grid 102 is complete, having a game piece 134 placed into each puzzle cell 120. The two strategy grids, the row grid (Y) 104 and the column grid (Z) 106 are void any numbers.

The Sudoku strategy aid layout 100 can be provided in many form factors. Several exemplary embodiments are presented in FIGS. 16 through 20. The Sudoku strategy aid layout 100 comprising a Sudoku strategy game board 300 and a plurality of row game pieces 320 and column grid game pieces 330. The Sudoku strategy game board 300 can utilize several embodiments for temporarily securing game pieces 320, 330 to the Sudoku strategy game board 300. Although the disclosure presents a variety of embodiments, the means for temporarily securing game pieces 320, 330 to the Sudoku strategy game board 300 is only limited by the knowledge of those skilled in the art. One embodiment utilizes a magnetic attraction between the Sudoku strategy game board 300 and the game pieces 320, 330. Another embodiment utilizes a reusable adhesive for securing the game pieces 320, 330 to the Sudoku strategy game board 300. Yet another embodiment utilizes a dense hook and loop material (commonly referred to as Velcro®) for securing the game pieces 320, 330 to the Sudoku strategy game board 300. Yet another embodiment utilizes a game piece receiving cavity 340 placed into each of the three grids 102, 104, and 106, as illustrated in FIG. 20. The row game pieces 320 is inserted via a game piece insertion 344 into the game piece receiving cavity 340 and held via a friction fit, the friction being created between a game piece side wall 326 of the row game pieces 320 and a cavity side wall 342 of the game piece receiving cavity 340.

Figure 19:
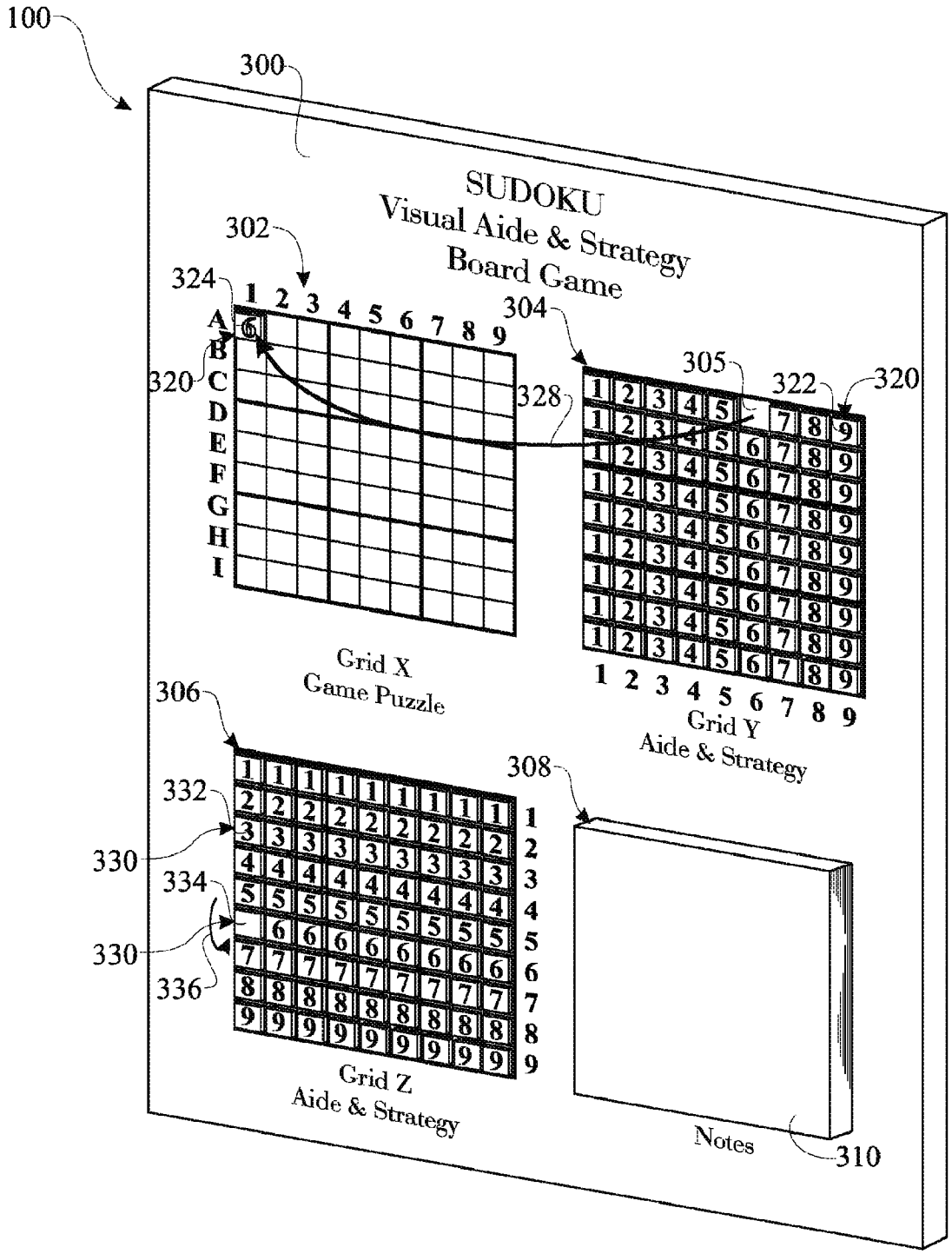
FIG. 19 is an isometric, top view of a Sudoku Visual Aid and Strategy board game of FIG. 18, further presenting an exemplary step for positioning the game pieces into a starting configuration.
Figure 20:
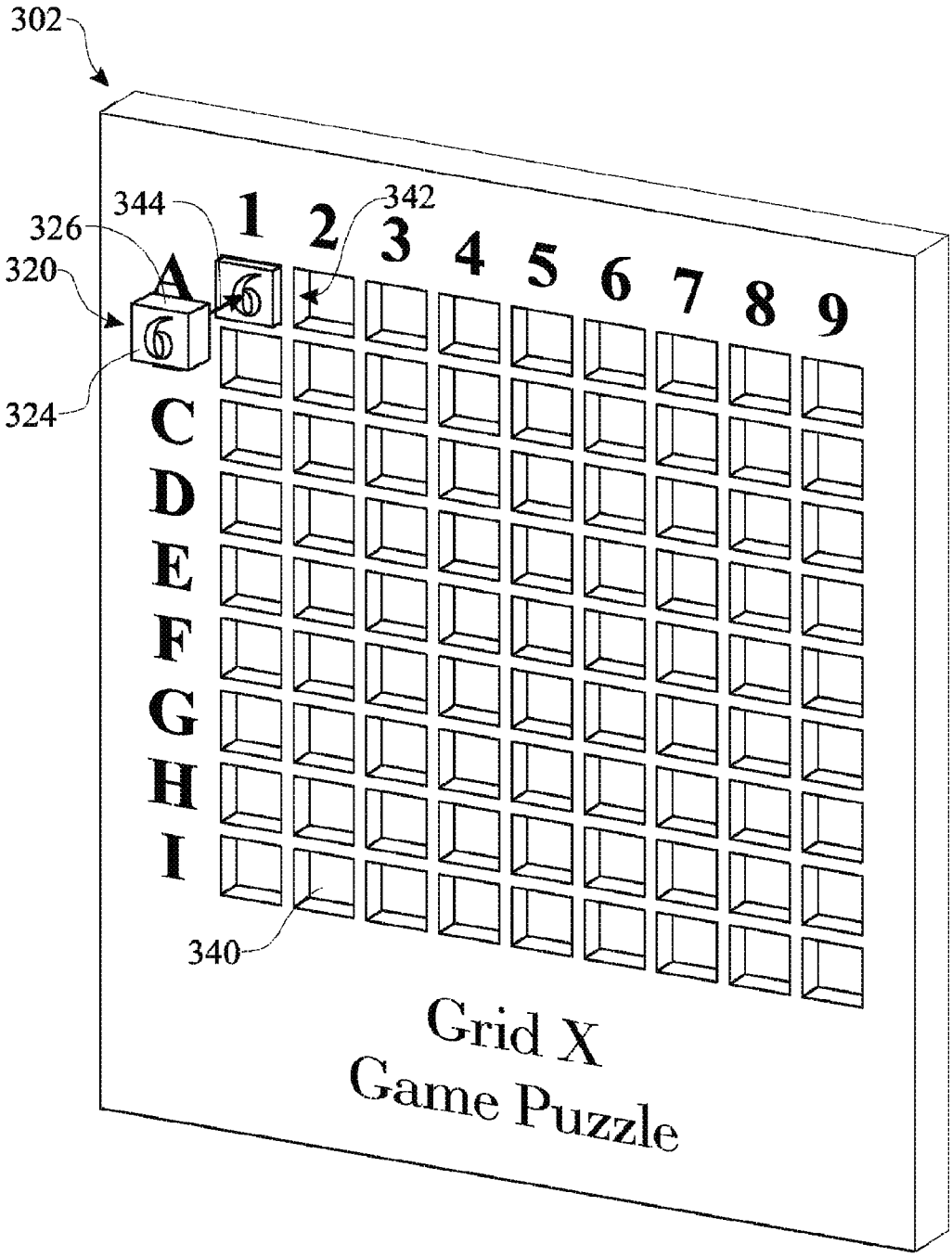
FIG. 20 is an isometric, top view presenting details of a game board utilizing game piece cavities for securing the game pieces.
Figure 21:
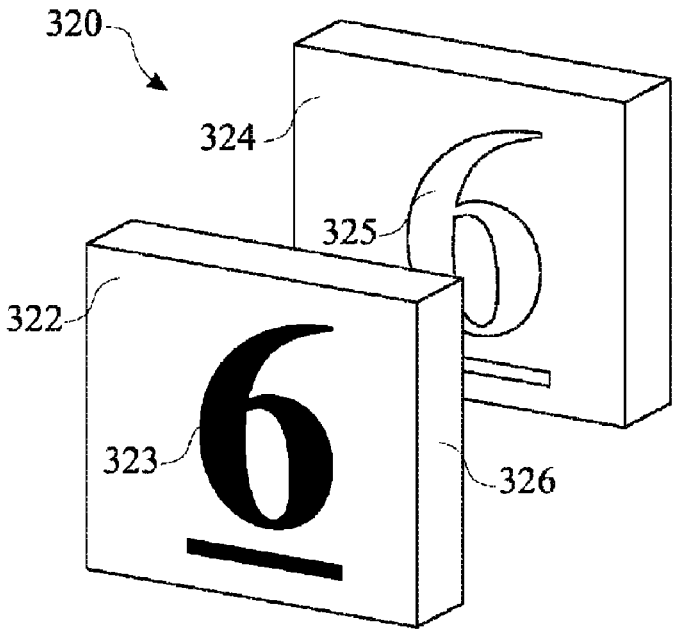
FIG. 21 presents an isometric view of an exemplary game piece, presenting a playing side and a puzzle starter side.

The method of arranging the game into a starting configuration is shown in FIG. 19. The player obtains a Sudoku puzzle and utilizes the layout to generate the starting configuration on the Sudoku strategy game board 300. An example is presented showing the number "6" being placed into puzzle grid cell 303 (1A). The player identifies the respective row game pieces 320 (number "6") from the corresponding row (A) of the row grid (Y) 304 and transfers 328 the respective row game pieces 320 from the row grid cell 305 (6A) of the row grid (Y) 304 to the desired puzzle grid cell 303 (1A) of the puzzle grid (X) 302. The row game pieces 320 is placed having the game piece starter face 324 face of the row game pieces 320 showing. This leaves the row grid cell 305 (6A) of the row grid (Y) 304 blank. The player then identifies the respective column grid game pieces 330 from the corresponding column (6) of the column grid (Z) 306 and inverts 334 the column grid game pieces 330, presenting a column piece available face 332 in the column grid cell 307 (row 1, column 7) of the column grid (Z) 306. A notes section 308 comprising a note pad (or similar) can be included on the game board 300 providing the player with an area in which the player can make notations.

Various embodiments of game and strategy pieces are presented in FIGS. 21 through 26. Details of the row game pieces 320 are presented in FIG. 21. The row game pieces 320 comprising a game piece playing face 322, a game piece starter face 324, and a game piece side wall 326. A game piece playing face marking 323 is applied to the game piece playing face 322 to present the user with an available number. A game piece starter face marking 325 is applied to the game piece starter face 324 to present the user with a starter number, wherein the image of the game piece starter face marking 325 is distinctly different from the image of the game piece playing face marking 323 to distinguish between a starting game piece and a playing game piece. The difference can be in color, font, style, artwork, and the like.

Figure 22:
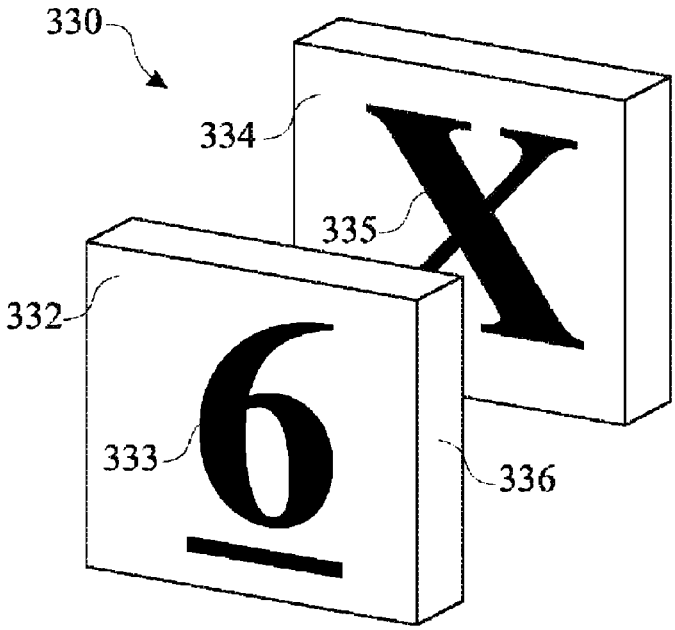
FIG. 22 presents an isometric view of an exemplary column strategy game piece, presenting an available side and a placed side.
Figure 23:
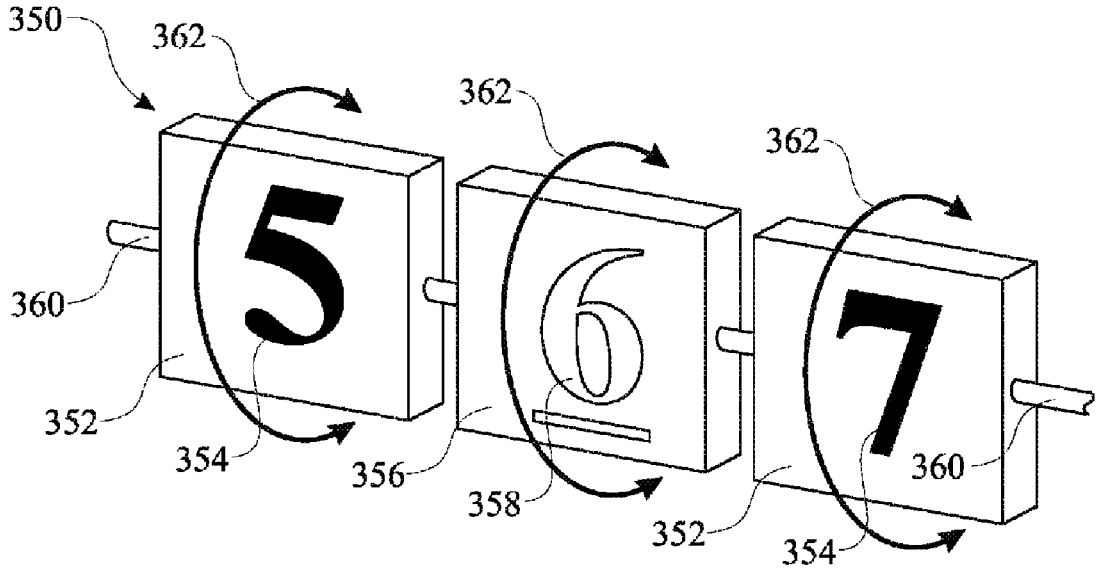
FIG. 23 presents an isometric view of an exemplary rotating column grid game piece, presenting an available side and a placed side.
Figure 24:
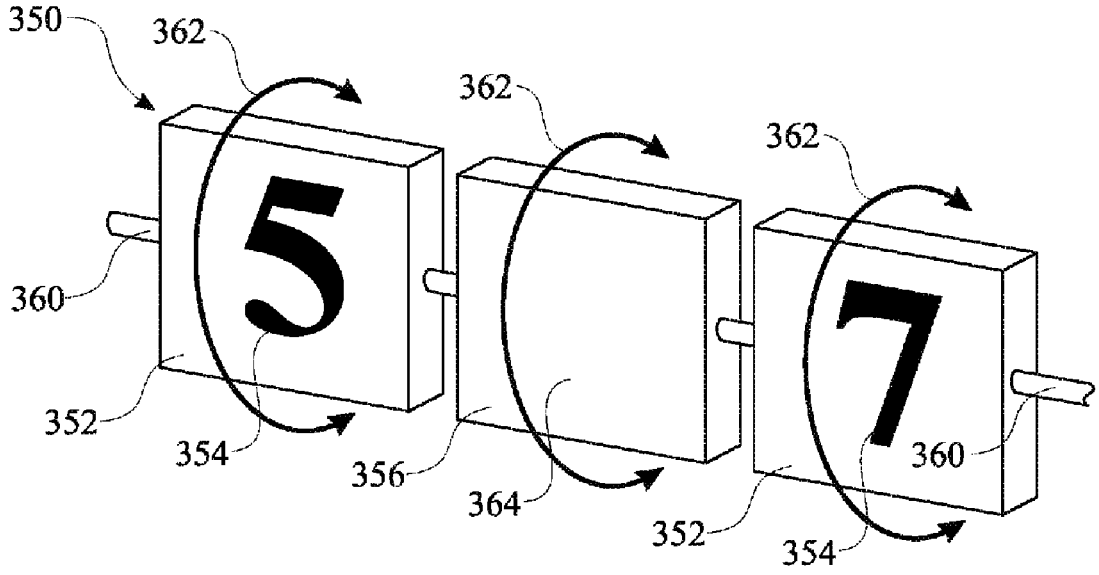
FIG. 24 presents an isometric view of the exemplary rotating column grid game piece of FIG. 23, presenting the available side and an alternate placed side.
Figure 25:
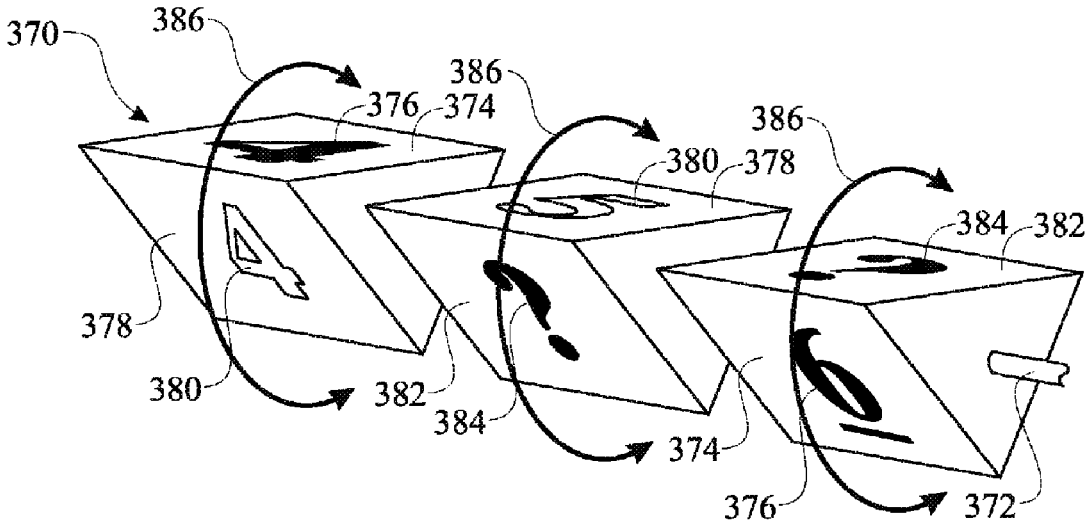
FIG. 25 presents an isometric view of an alternate exemplary rotating column grid game piece, presenting an available side, a placed side, and an uncertain side.
Figure 26:
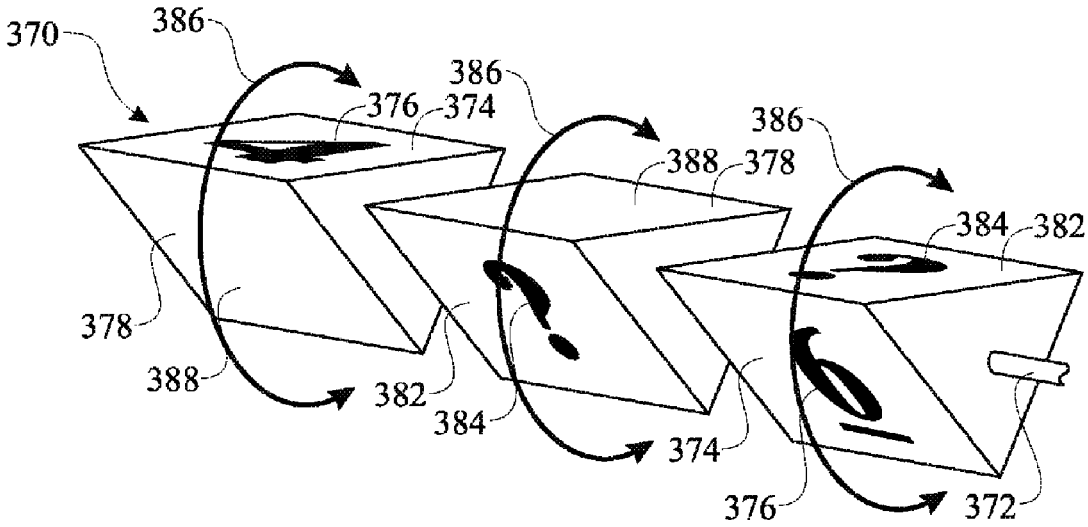
FIG. 26 presents an isometric view of the alternate exemplary rotating column grid game piece of FIG. 25, presenting the available side, an alternate placed side, and the uncertain side.

Details of the column grid game pieces 330 are presented in FIG. 22. The column grid game pieces 330 comprising a column piece available face 332, a column piece placed face 334, and a game piece sidewall 336. A column piece available face marking 333 is applied to the column piece available face 332 to present the user with an available number. A game piece starter face marking 325 is applied to the game piece starter face 324 to present the user with a placed number, wherein the image of the game piece starter face marking 325 is distinctly different from the image of the game piece playing face marking 323 to distinguish between a starting game piece and a playing game piece. The column piece placed face marking 335 can be a number having a different image, such as color, font, style, artwork, and the like, as well as a letter such as an "X" (as shown), or simply left blank. Since the column grid game pieces 330 can remain in the same cell 307, the column game pieces can be pivotally assembled to the game board. Examples of two embodiments are presented in FIGS. 23 through 26. A two-sided version of the column grid game pieces 330 is presented in FIGS. 23 and 24. A plurality of pivoting column game piece 350 is pivotally assembled to a pivot axle 360. Each pivoting column game piece 350 rotates via a pivoting motion 362 about the pivot axle 360 presenting either an available face image 354 on an available face 352 of the pivoting column game piece 350 or a played face image 358 on a played face 356 of the pivoting column game piece 350. An alternate design utilizes a blank image 364 on the played face 356. A three-sided version of the column grid game pieces 330 is presented in FIGS. 25 and 26. A plurality of three-sided pivoting column game piece 370 is pivotally assembled to a pivot axle 372. Each three sided pivoting column game piece 370 rotates via, a pivoting motion 386 about the pivot axle 372 presenting either any one of the three sides: (1) an available face image 376 on an available face 374 of the three sided pivoting column game piece 370, (2) a played face image 380 on a played face 378 of the three sided pivoting column game piece 370, or a (3) a uncertain move face image 384 on a uncertain move face 382 of the three sided pivoting column game piece 370. An alternate design utilizes a blank image 388 on the played face 378.

Figure 27:
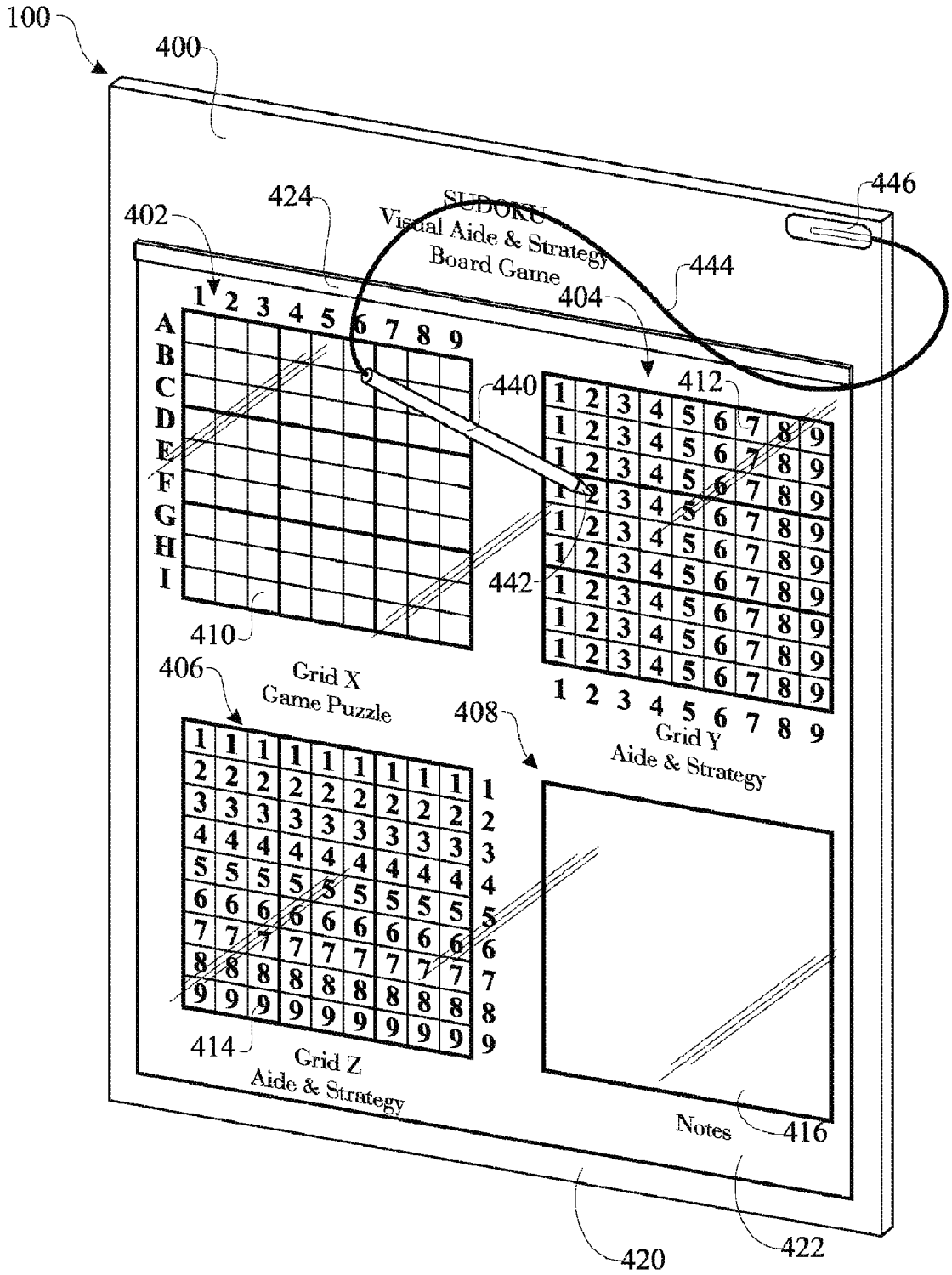
FIG. 27 presents an isometric view of a cellophane scribing version of the Sudoku Visual Aid and Strategy board game.
Figure 28:
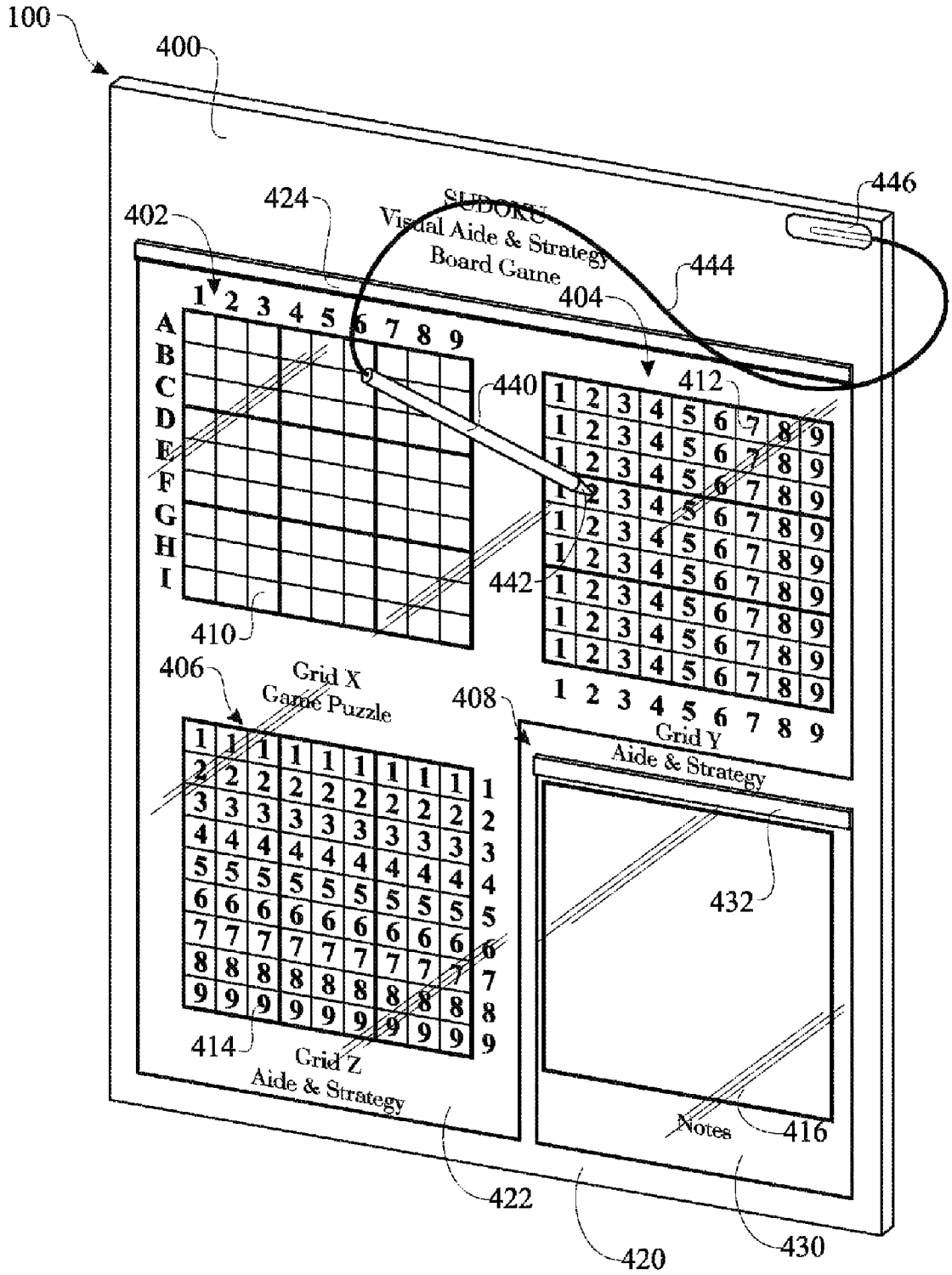
FIG. 28 presents an isometric view of a cellophane-scribing version of the Sudoku Visual Aid and Strategy board game of FIG. 27, further incorporating a separate notes section.

Yet another embodiment of the Sudoku strategy aid layout 100 is a cellophane marking game board 400 (FIG. 27). The cellophane marking game board 400 comprising a cellophane layer 422 coupled to a marking game board backing 420 via a cellophane securing strip 424. The cellophane layer 422 is a clear cellophane material placed over the marking game board backing 420. The marking game board backing 420 is a black or colored material, wherein when the player scribes on the cellophane layer 422, the cellophane layer 422 contacts the marking game board backing 420 showing what was scribed. The player can lift the cellophane layer 422 away from the marking game board backing 420 removing the presented scribing. This design is commonly known and used in children's games. The player can write onto the cellophane layer 422 using a stylus tip 442 of a marking stylus 440. The marking stylus 440 is secured to the cellophane marking game board 400 via a stylus lanyard 444, having one end secured to the distal end of the marking stylus 440 and the opposing end secured to the marking game board backing 420 via a lanyard anchor 446. The game layout as described in FIG. 1 can be applied to either the marking game board backing 420 or the cellophane layer 422. The game layout comprising the three (3) grids, Sudoku puzzle grid 402, row grid (y) 404, and column grid (Z) 406. Additionally, the game layout can include an optional note section 408. Each of the three grids comprising the desired number of cells (generally 81 arranged in a 9 by 9 array). The cells puzzle cells 410, row grid cells 412, and column grid cells 414 for each grid Sudoku puzzle grid 402, row grid (y) 404, and column grid (Z) 406 respectively. A note taking section is provided within the note section 408. There is a probability that the player would want to clear the note taking area 416 without impacting the various grids 402, 404, 406. A notes section cellophane layer 430 is secured to the marking game board backing 420 via a note section cellophane securing strip 432, wherein the notes section cellophane layer 430 covers the note taking area 416 as illustrated in FIG. 28. The cellophane layer 422 would then be shaped as shown to clear the notes section cellophane layer 430.

The game board can be created in a multitude of sizes for a multitude of applications and embodiments, including but not limited to, a portable table top game version, a portable hand held or travel version, a bound pad, book or notebook version which allows the user to remove/discard a sheet once it has been used, revealing a new sheet below the one which was used, an electronic version, and a variety of other embodiments not referred to herein which perform the same function and are to be considered apparent and obvious to the disclosure by those skilled in the art.

Figure 29:
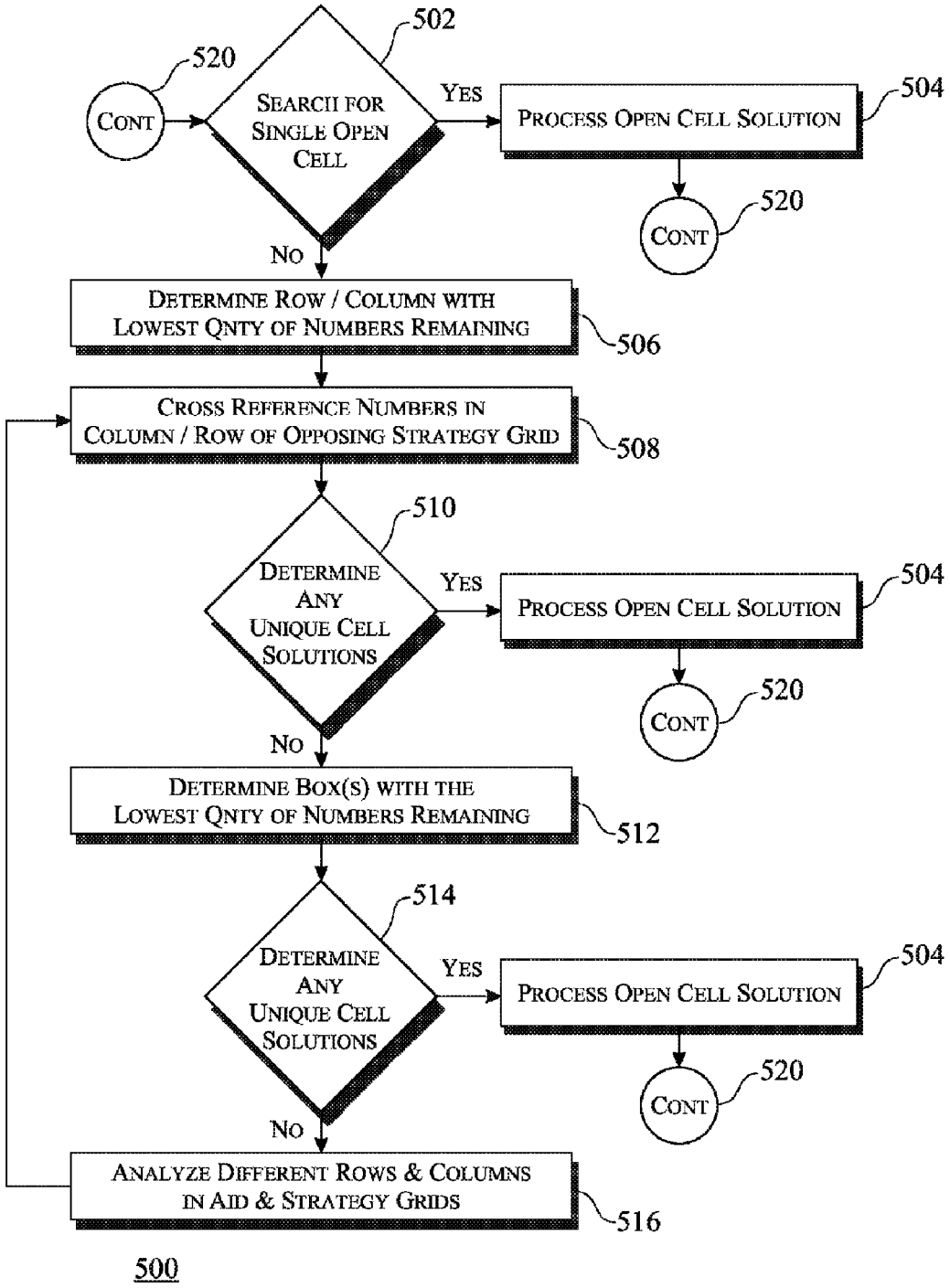
FIG. 29 presents a general strategy assisting flow diagram.

The game aid strategy previously demonstrated by an example puzzle is presented in a flow diagram format in FIG. 29. The flow diagram presents a generic overview, wherein the details were previously presented by examples in FIGS. 4-15 herein. An aide and strategy overview flow diagram 500 initiates with the player searching for a single open cell step 502 within a row 132, a column 138, and a box 122. If a single open cell is identified, the player completes a process the solution for the open cell step 504 by inserting the missing number into the puzzle grid (X) 102, removing the same number from the respective row 132 of the row grid (Y) 104, and removing the same number from the respective column 138 of the column grid (Z) 106. Once the process the solution for the open cell step 504 is completed, the player continues 520 with another search 502. If a single open cell is not found, the player proceeds with a step of determining the row/column with the lowest quantity of numbers remaining 506. The player then continues with a step of cross-referencing the numbers in the column/row of the opposing strategy grid 508. The player is searching for any matching combinations, wherein the matching combinations present a solution into an open cell. The player then completes a decision step of determining any unique cell solutions 510. If a unique open cell solution is identified, the player completes the process the solution for the open cell step 504 as previously described. If a unique open cell solution is not found, the player proceeds with a step of searching for box's with the lowest quantity of numbers remaining 512. The player then completes a decision step of determining any unique cell solutions 514 for the box. If a unique open box cell solution is identified, the player completes the process the solution for the open cell step 504 as previously described. If a unique open box cell solution is not found, the player proceeds with a step of analyzing a different row/column of the aid and strategy grids 516, returning to the step of cross-referencing the numbers in the column/row of the opposing strategy grid 508.

Figure 30:
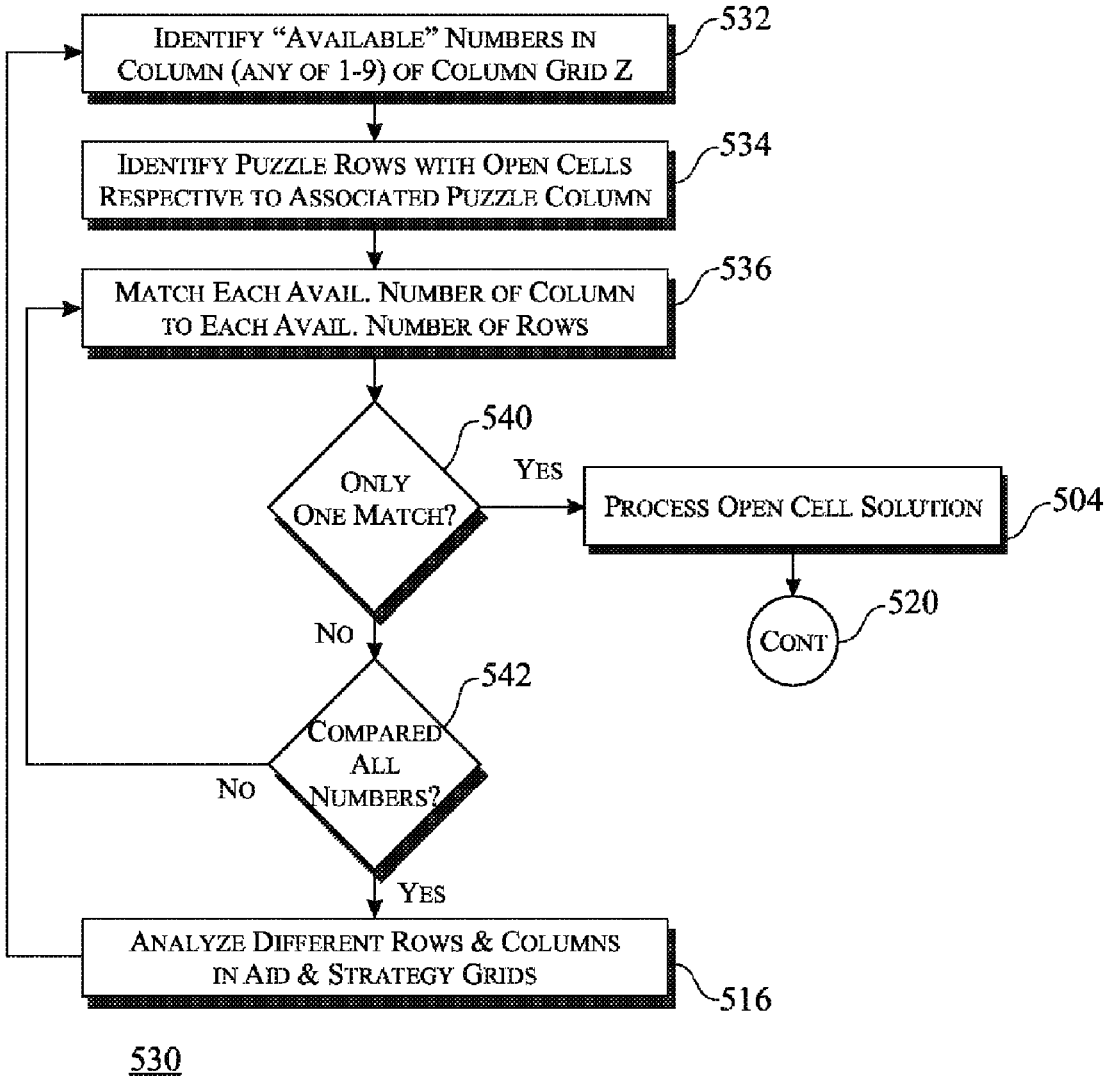
FIG. 30 presents a row and column strategy assisting flow diagram.

The row and strategy portion of the game aid strategy previously demonstrated by an example puzzle is presented in a flow diagram format in FIG. 30. The flow diagram presents a generic overview, wherein the details were previously presented by examples in FIGS. 4-15 herein. A row and column aide and strategy flow diagram 530 initiates with the player completing a step of identifying the "available" numbers in a column of the column Grid (Z) 532. The player would identify one of the columns 138 from the columns 138 (1) through (9) of the column grid (Z) 106. The player then identifies the respective puzzle rows 114 with open cells in the same column 138 that the player has identified in step 532. This is referred to as an identify puzzle rows having open cells in respective to the selected column step 534. The player then compares the "available" numbers of the column 138 with the available numbers of the rows 132 associated with the open cells of the puzzle rows 114 respective to the selected column step 534. This is referred to as a matching available numbers step 536. If a unique open cell solution is identified, the player completes the process the solution for the open cell step 504 as previously described. If a unique open cell solution is not found, the player proceeds with a decision step of determining if all numbers in the selected column 138 have been considered 540. If all of the "available" numbers of the selected column 138 haven't been considered, the player returns to step 536 considering a different number. If all of the "available" numbers of the selected column 138 have been considered, the player selects a different column 138 to consider and completes the step of analyzing a different column step 516. With that, the player returns to step 532 using a different column 138. The player can alternately utilize a similar process selecting a row 132 of the row grid (Y) 104 and using the columns 138 as the aid respectively.

Figure 31:
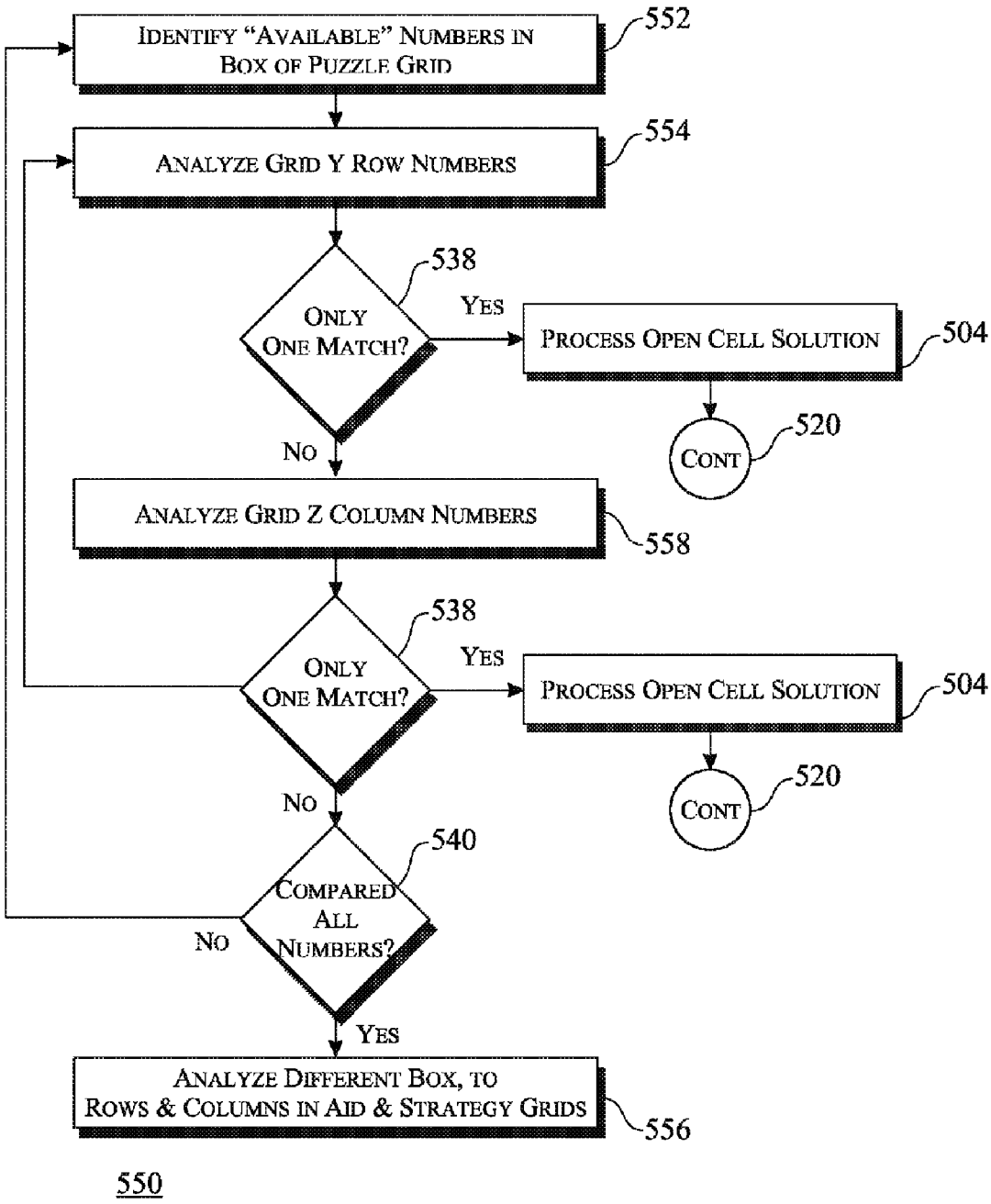
FIG. 31 presents a box strategy assisting flow diagram.

Should the rows and columns be unsuccessful in providing a solution, the player can utilize a grid aid and strategy flow diagram 550 as presented in FIG. 31. The grid aid 550 initiates with a box available numbers identification step 552, whereby the player inspects the various box's 122 and selects box's 122 within the puzzle grid 102 with the lowest number of "available" numbers. The player then completes a step of analyzing the row grid (Y) "available" numbers 554 to determine if there are any unique matches 538 for the open cells within the box 122. If a unique open cell solution is identified, the player completes the process the solution for the open cell step 504 as previously described. If a unique open cell solution is not found, the player then completes a step of analyzing the column grid (Z) "available" numbers 558 to determine if there are any unique matches 540 for the open cells within the box 122. If a unique open cell solution is identified, the player completes the process the solution for the open cell step 504 as previously described, If a unique open cell solution is not found, the player then completes a step of determining if all "available" numbers of the box have been considered 540. If other "available" numbers have not been analyzed, the player continues with by analyzing the other remaining "available" numbers. If all "available" numbers have been considered, the player can proceed with a step of analyzing a different box 556.

It is recognized that the player can additionally create a Sudoku puzzle using the game as presented.

It will be recognized and understood by those skilled in the art that numerous variations of game play are possible in application of the game apparatus 1 and that the foregoing descriptive method of play is exemplary only and should not be interpreted in a limiting sense.

It is recognized that the present invention can be computerized, utilizing components of a commonly known computer, including a processor, memory, a display, and a power regulating circuit.

While the preferred embodiments of the invention have been described above, it will be recognized and understood that various modifications can be made in the invention and the appended claims are intended to cover all such modifications which may fall within the spirit and scope of the invention.

What is claimed is:

1. A method for solving a Sudoku game puzzle, the method comprising the steps:

accessing a computer comprising operational software and a display;

displaying a layout upon the display for use as a tool for solving a Sudoku game puzzle, the layout comprising:

a. a Sudoku puzzle grid comprising nine rows and nine columns, each row and column having nine cells wherein the grid comprising a total of eighty-one cells, the grid being divided into nine boxes, each box having cells from three adjacent rows and three adjacent columns comprising a total of nine cells;

b. a row grid comprising nine rows arranged in horizontal alignment, each row sectioned into nine cells; and c. a column grid comprising nine columns arranged in vertical alignment, each column sectioned into nine cells;

presenting a sequential series of numbers inserted into each row of the row grid and distributed with one number per cell;

presenting a sequential series of numbers inserted into each column of the column grid and distributed with one number per cell;

presenting a series of starter numbers distributed about a portion of the cells of the Sudoku puzzle grid;

identifying each number in each row of the row grid matching a starter number presented in an associated row of the Sudoku puzzle grid and indicating the respective numbers as already placed upon the display;

identifying each number in each column of the column grid matching a starter number presented in an associated column of the Sudoku puzzle grid and indicating the respective numbers as already placed upon the display;

determining a correct number to be inserted into a vacant cell within the Sudoku puzzle grid by:

determining a row grid row associated with the vacant cell within the Sudoku puzzle grid;

determining a column grid column associated with the vacant cell within the Sudoku puzzle grid;

utilizing the numbers remaining in each of the row grid row and the column grid column associated with the vacant cell to determine a set of potential solution numbers for the vacant Sudoku puzzle grid cell;

utilizing a Sudoku puzzle solution method to further reduce the set of potential solution numbers to determine a single solution number;

entering the single solution number into a solution Sudoku puzzle grid cell associated with both of the row grid row and column grid column; and displaying the single solution number in the subject vacant cell.

2. A method for solving a Sudoku game puzzle as recited in claim 1, the method comprising the additional steps of:

identifying the number that matches the single solution number from the sequential series of numbers disposed in a row of the row grid associated with a row of the Sudoku puzzle grid cell associated with the most recent single solution number;

indicating on the associated row of the row grid display that the respective number as already placed into the Sudoku puzzle grid; and indicating on the associated column of the column grid display that the respective number as already placed into the Sudoku puzzle grid.

3. A method for solving a Sudoku game puzzle as recited in claim 2, the method comprising the additional steps of:

repeating each of the following processes to determine subsequent single solution numbers:

determining a correct number to be inserted into each subsequent vacant cell within the Sudoku puzzle grid by:

determining a row grid row associated with each subsequent vacant cell within the Sudoku puzzle grid;

determining a column grid column associated with each subsequent vacant cell within the Sudoku puzzle grid;

utilising the numbers remaining in each of the row grid row and the column grid column associated with each subsequent vacant cell to determine a subsequent set of potential solution numbers for the vacant Sudoku puzzle grid cell;

utilising Sudoku puzzle solution methods to further reduce the subsequent set of potential solution numbers to determine each subsequent single solution number;

entering each subsequent single solution number into each respective vacant Sudoku puzzle grid cell associated with both of the row grid row and column grid column;

indicating on the associated row of the row grid display that the respective number as already placed into the Sudoku puzzle grid; and indicating on the associated column of the column grid display that the respective number as already placed into the Sudoku puzzle grid.

* * * * *